US008091523B2

(12) United States Patent
Mikawa et al.

(10) Patent No.: US 8,091,523 B2
(45) Date of Patent: Jan. 10, 2012

(54) APPARATUS FOR AND METHOD OF CONTROLLING VARIABLE VALVE TIMING MECHANISM

(75) Inventors: Kentaro Mikawa, Isesaki (JP); Naoki Okamoto, Isesaki (JP)

(73) Assignee: Hitachi, Ltd., Tokyo (JP)

( * ) Notice: Subject to any disclaimer, the term of this patent is extended or adjusted under 35 U.S.C. 154(b) by 429 days.

(21) Appl. No.: 12/471,612

(22) Filed: May 26, 2009

(65) Prior Publication Data

US 2009/0288621 A1 Nov. 26, 2009

(30) Foreign Application Priority Data

May 26, 2008 (JP) ..... 2008-136849

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | | |
|---|---|---|---|---|
| 7,159,545 | B2 | 1/2007 | Miyakoshi et al. | |
| 7,308,877 | B2 * | 12/2007 | Izumi et al. | 123/90.17 |
| 2007/0221150 | A1 | 9/2007 | Inoue et al. | |

FOREIGN PATENT DOCUMENTS

| | | |
|---|---|---|
| JP | 2001-241339 | 9/2001 |
| JP | 2003-129806 | 5/2003 |
| JP | 2005-036760 | 2/2005 |
| JP | 2005-291200 | 10/2005 |
| JP | 2007-262914 | 10/2007 |

* cited by examiner

*Primary Examiner* — Zelalem Eshete
(74) *Attorney, Agent, or Firm* — Antonelli, Terry, Stout & Kraus, LLP.

(57) ABSTRACT

The application provides a control apparatus of a variable valve timing mechanism capable of converging valve timing to a target value with good responsiveness as well as with high accuracy when an engine starts. In the state where the engine starts, the variable valve timing mechanism is driven to a target value at the engine start by a second manipulated variable corresponding to a maximum variation speed of valve timing. Valve timing is estimate in the state where the variable valve timing mechanism is driven by the second manipulated variable, and when the estimated valve timing reaches the target value, a manipulated variable is switched from the second manipulated variable to a first manipulated variable which is a feedforward manipulated variable or to the first manipulated variable which is a value obtained by adding the feedforward manipulated variable and a feedback manipulated variable.

20 Claims, 24 Drawing Sheets

APPARATUS FOR AND METHOD OF CONTROLLING VARIABLE VALVE TIMING MECHANISM

BACKGROUND OF THE INVENTION

1. Field of the Invention

The present invention relates to an apparatus for and a method of controlling a variable valve timing mechanism that varies valve timing of an engine valve.

2. Description of the Related Art

Japanese Laid-Open (Kokai) Patent Application Publication No. 2005-291200 discloses that when an engine stops, a manipulated variable of a variable valve timing mechanism is feedback-controlled so that valve timing approaches a target of when an engine starts, and the manipulated variable at that time is stored, and then, the stored manipulated variable is output to the variable valve timing mechanism when the engine restarts.

Incidentally, at the start of engine, a start period of time can be reduced by varying valve timing to a target of when the engine starts, without overshooting and with high responsiveness.

However, in the feedback control, since a manipulated variable is set in response to the difference between the target and actual valve timing, when it is intended to avoid overshoot, responsiveness might be deteriorated, and thus a period time before reaching the target might increases.

In contrast, in a feedforward control, although responsiveness can be improved, there is a possibility that overshoot occurs and valve timing is converged to a timing different from the target.

SUMMARY OF THE INVENTION

Accordingly, an object of the present invention is to provide an apparatus for and a method of controlling a variable valve timing mechanism capable of converging valve timing to a target of when an engine starts with high responsiveness and high accuracy, when the engine starts.

To achieve the object, the present invention provides a novel technical concept of the apparatus and method that: calculates a first manipulated variable based on target valve timing as well as calculating a second manipulated variable by which a variation speed of the valve timing is maximized; estimates the valve timing when the second manipulated variable is output to the variable valve timing mechanism; determines that it is a timing to switch the second manipulated variable to the first manipulated variable based on a result of comparison of the estimated value of the valve timing with the target valve timing; and at the starting of the engine, outputs the second manipulated variable to the variable valve timing mechanism before it is determined to be the switching timing whereas outputs the first manipulated variable to the variable valve timing mechanism after it is determining to be the switching timing.

The other objects and features of this invention will be understood from the following description with reference to the accompanying drawings.

DESCRIPTION OF THE PREFERRED EMBODIMENTS

Figure 1:
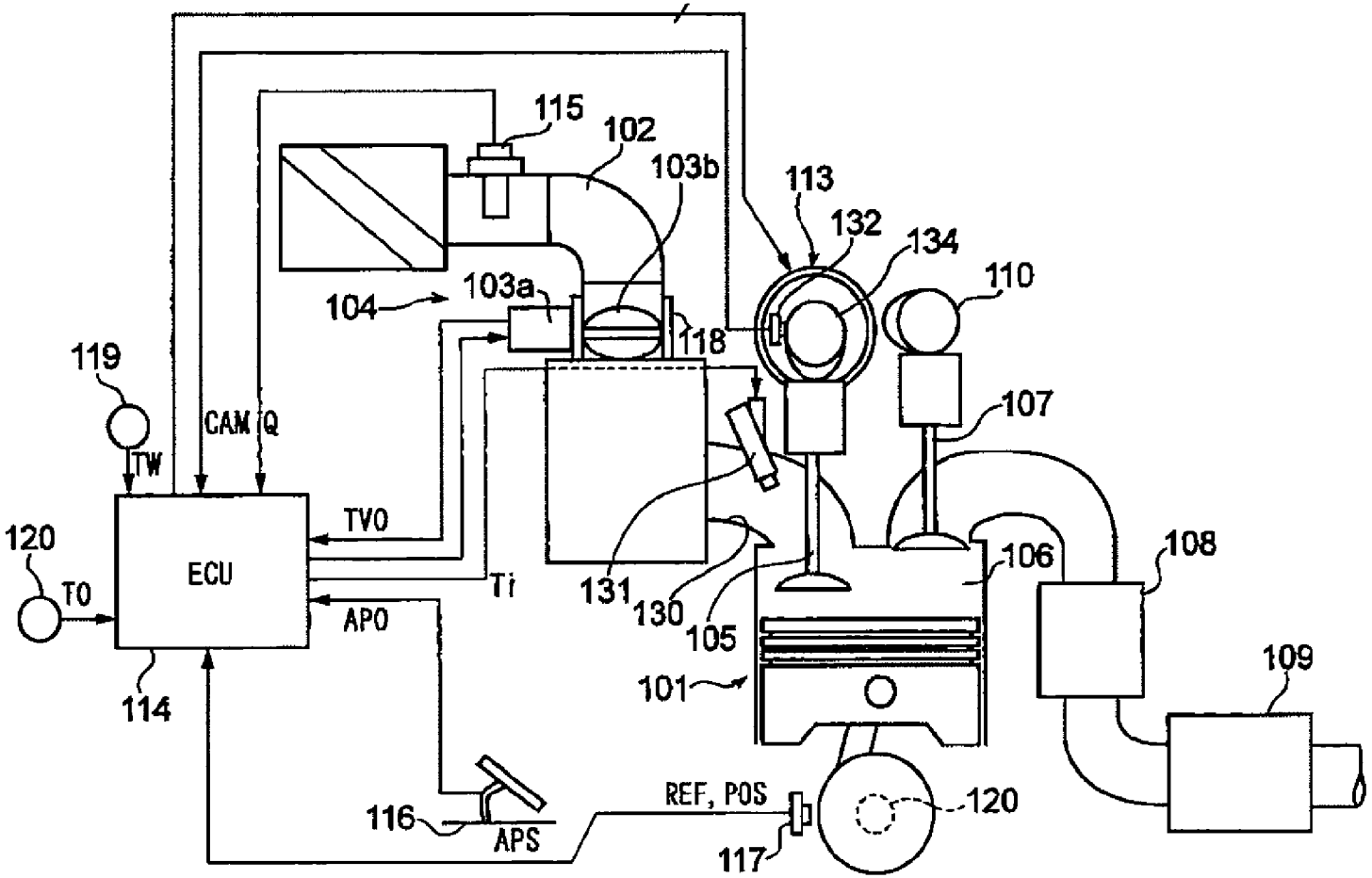
FIG. 1 is a block diagram illustrating a systematic construction of an engine of an embodiment according to the present invention.

FIG. 1 is a block diagram illustrating a systematic construction of a vehicular engine of an embodiment.

In FIG. 1, in an intake pipe 102 of an engine (internal combustion engine) 101, an electronic control throttle 104 is interposed. Through electronic control throttle 104 and an intake valve (engine valve) 105, air is sucked into a combustion chamber 106.

Electronic control throttle 104 is a device in which a throttle valve **103*b* is driven by a throttle motor 103*a***.

Combustion exhaust gas is discharged from combustion chamber 106 through an exhaust valve 107 and discharged into the atmosphere after being purified by a front catalyst converter 108 and a rear catalyst converter 109.

Intake valve 105 and exhaust valve 107 are opened and closed by cams disposed to an intake camshaft 134 and an exhaust camshaft 110, respectively.

There is provided a variable valve timing mechanism 113 which continuously varies valve timing of intake valve 105 by varying the rotating phase of intake camshaft 134 relative to a crank shaft 120.

Further, on an intake port 130 in an upstream of intake valve 105, a fuel injection valve 131 is disposed for each cylinder.

Fuel injection valve 131 is opened in response to an injection pulse signal TI provided from an engine control unit 114 and injects a fuel toward intake valve 105.

Engine control unit 114 has a built-in micro computer and controls electronic control throttle 104, variable valve timing mechanism 113, fuel injection valve 131, and the like by an arithmetic process based on detection signals from various types of sensors.

As the various sensors. There are provided an accelerator opening sensor 116 for detecting an accelerator opening degree APO, an air flow sensor 115 for detecting an intake air amount Q of engine 101, a crank angle sensor 117 for outputting a reference crank angle signal REF of each reference crank angle position and a unit angle signal POS of each unit crank angle of crank shaft 120, a throttle sensor 118 for detecting an opening degree TVO of throttle valve 103*b*, a water temperature sensor 119 for detecting a cooling water temperature TW of engine 101, an oil temperature sensor 120 for detecting a lubricant temperature TO of engine 101, a cam sensor 132 for outputting a cam signal CAM of each reference cam angle of intake camshaft 134, and the like.

Engine control unit 114 calculates an engine rotation speed Ne based on reference crank angle signal REF or unit angle signal POS output from crank angle sensor 117.

Next, a structure and a function of variable valve timing mechanism 113 will be described based on FIGS. 2 to 8.

Figure 2:
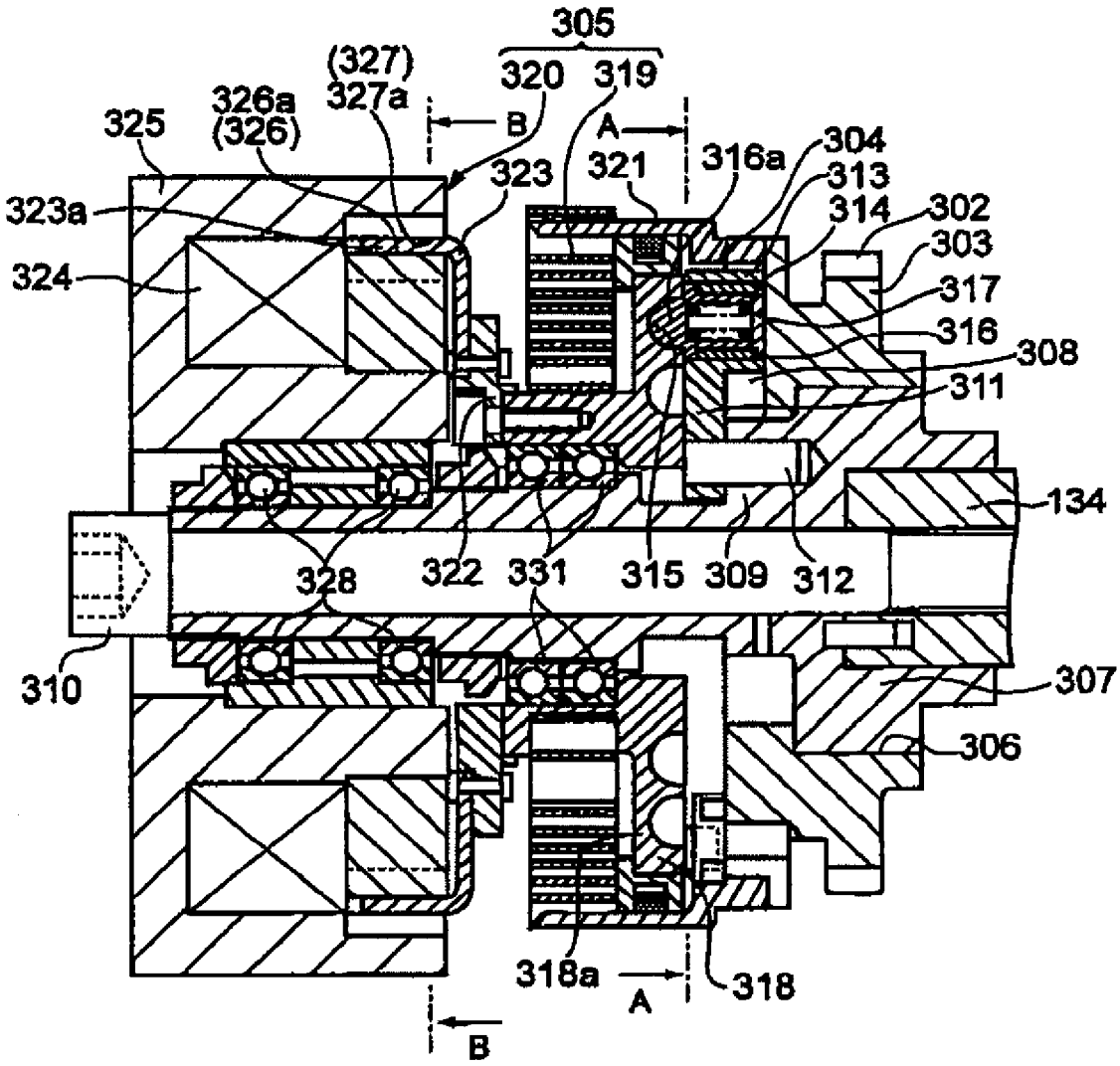
FIG. 2 is a sectional view illustrating an electromagnetic brake type variable valve timing mechanism of the embodiment.

As shown in FIG. 2, variable valve timing mechanism 113 has intake camshaft 134, a drive ring 303, an assembly angle operation mechanism 304 that is disposed forward of drive ring 303 and camshaft 134, to thereby operate an assembly angle of both 303 and 134, and a drive device 305 that is disposed further forward of assembly angle operation mechanism 304 and drives assembly angle operation mechanism 304.

Drive ring 303 is relatively-rotatably assembled to a front end of intake camshaft 134 and has a timing sprocket 302 around an outer periphery thereof which is connected to crank shaft 120 via a not-shown chain.

Further, drive ring 303 is formed in a cylindrical shape and has an insertion hole 306 formed at the center thereof, and the portion of insertion hole 306 is rotatably assembled to a driven member 307 coupled with the front end of intake camshaft 134.

Figure 3:
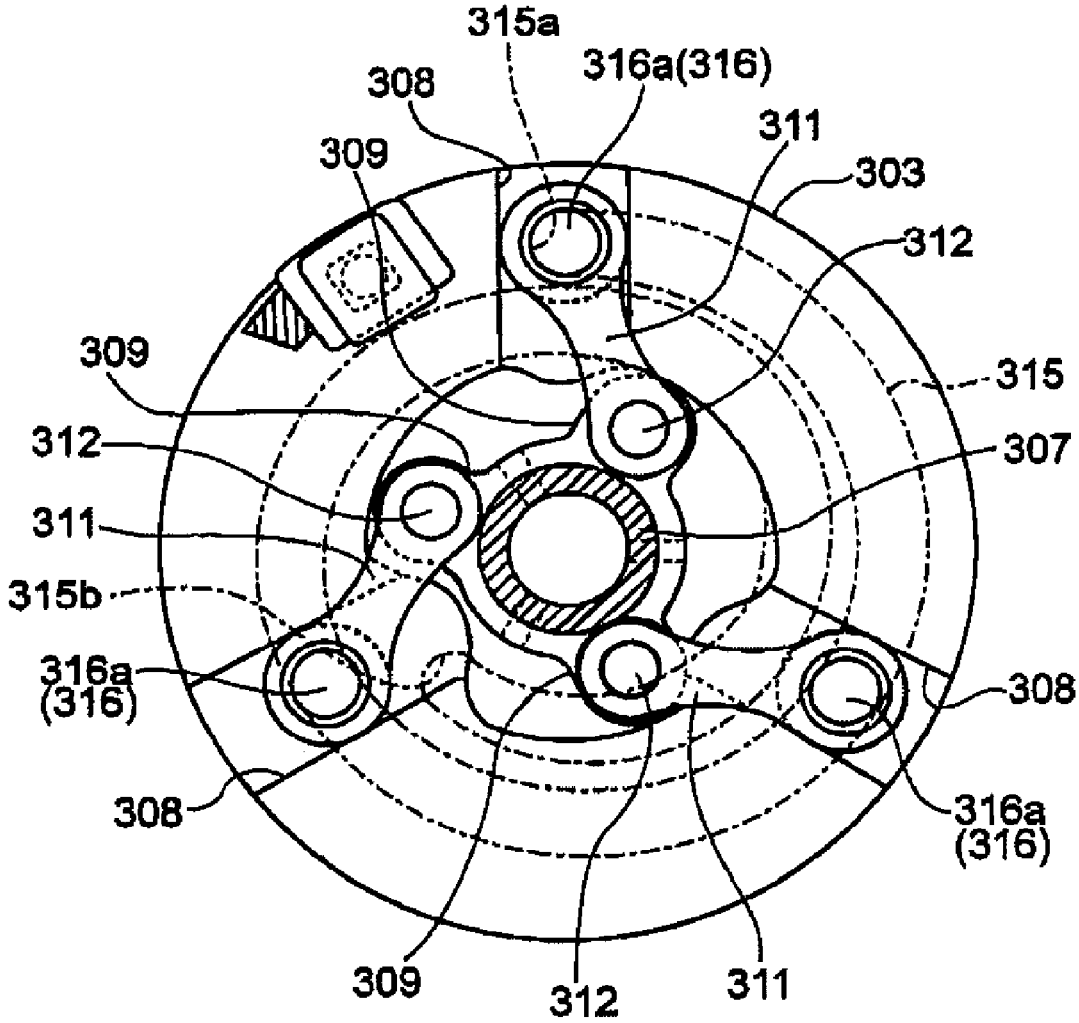
FIG. 3 is a sectional view taken along a line A-A of FIG. 2.

As shown in FIG. 3, three grooves 308 each having confronting parallel walls are formed on a front surface of drive ring 303 along a radial direction of drive ring 303.

Further, as shown in FIG. 2, driven member 307 has three levers 309 projecting radially and formed integrally therewith around an outer peripheral surface thereof located forward of a base portion which is butted against the front end of camshaft 134, and driven member 307 is coupled with intake camshaft 134 by a bolt 310 passing through an axial center.

With respective lever 309, base ends of links 311 are rotatably coupled through pins 312, and columnar projecting portions 313, which are engaged with grooves 308, are integrally formed on tip ends of respective links 311.

Respective links 311 are coupled with driven member 307 via pins 312 in a state where projecting portions 313 are coupled with grooves 308. Thus, when tip end sides of links 311 are displaced along grooves 308 by external force applied thereto, drive ring 303 and driven member 307 relatively rotate in a direction and by an angle according to the displacement of projecting portions 313 by an action of links 311.

Further, accommodation holes 314 are formed to the tip ends of respective links 311. In accommodation holes 314, there are accommodated engaging pins 316, which have projections 316*a* engaged with swirl-shaped grooves 315 to be described later, and coil springs 317 for urging engaging pins 316 to grooves 315.

In contrast, an intermediate rotating body 318 having a disc-shaped flange wall 318*a* is rotatably supported through a bearing 331 on the forward side of a projecting position of lever 309 of driven member 307.

To a rear surface side of flange wall 318*a* of intermediate rotating body 318, grooves 315 are formed. With grooves 315, engaging pins 316 at the tip ends of respective links 311 are engaged so as to be free to roll.

The swirl of each groove 315 is formed such that the diameter thereof is gradually reduced along the rotating direction of drive ring 303.

Accordingly, when intermediate rotary body 318 relatively rotates in a retard direction with respect to drive ring 303 in a state where engaging pins 316 of the tip ends of respective links 311 are engaged with grooves 315, and the tip ends of links 311 are guided by the swirl shape of grooves 315 and moved inwardly of a radial direction while being guided by grooves 308. Whereas when intermediate rotary body 318 relatively rotates in an advance direction the tip ends of links 311 are moved outwardly of the radial direction.

Assembly angle operation mechanism 304 is composed of grooves 308 of drive ring 303, links 311, projecting portions 313, engaging pins 316, lever 309, intermediate rotary body 318, grooves 315, and the like as described above.

When rotating operation force is input from drive device 305 to intermediate rotary body 318, the rotating operation force displaces the tip ends of links 311 in a diameter direction through the engaging portion of grooves 315 and engaging pins 316. At the time, relative rotation force is transmitted to drive link 303 and driven member 307 by the action of links 311 and lever 309, In contrast, drive device 305 is provided with a flat spiral spring 319, which urges intermediate rotary body 318 in the rotating direction of drive ring 303, and a hysteresis brake 320 as a mechanism which brakes intermediate rotary body 318 so as to urge it in a direction opposite to the rotating direction of drive ring 303. When the brake force of hysteresis brake 320 is appropriately controlled according to an operating state of engine, intermediate rotary body 318 is relatively rotated with respect to drive ring 303 or the rotating positions of both of them are maintained.

The outer peripheral portion of flat spiral spring 319 is coupled with a circular cylindrical member 321, which is integrally attached to drive ring 303, while, an inner peripheral portion of flat spiral spring 319 is coupled with a cylindrical base portion of intermediate rotary body 318, and flat spiral spring 319 as a whole is disposed in a space in front of flange wall 318*a* of intermediate rotary body 318.

In contrast, hysteresis brake 320 has a bottomed cylindrical hysteresis ring 323 attached to a front end of intermediate rotary body 318 via a retainer plate 322, an electromagnetic coil (electromagnetic actuator) 324 attached to a not-shown cover served as a non-rotary member with the rotation of electromagnetic coil 324 regulated, and a coil yoke 325 to which magnetism of electromagnetic coil 324 is induced. Energization of electromagnetic coil 324 is controlled by engine control unit 114 in response to an engine operating state.

Figure 6:
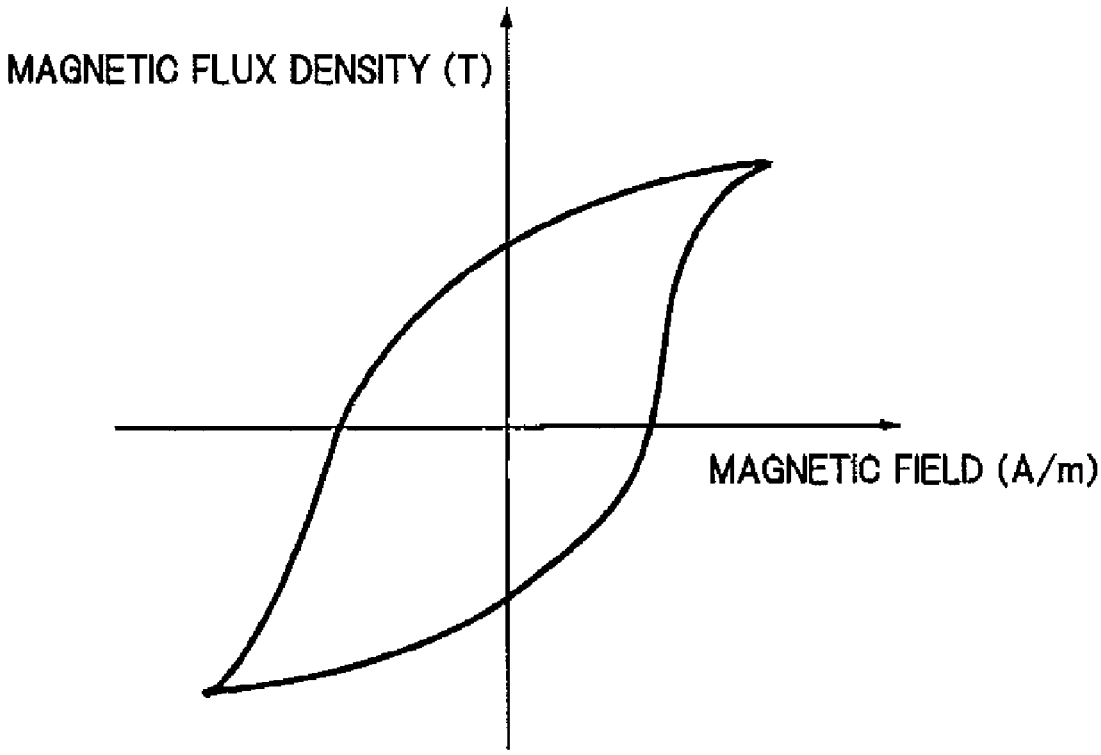
FIG. 6 is a graphical view illustrating the correlation between magnetic flux density and a magnetic field in the electromagnetic brake type variable valve timing mechanism.

As shown in FIG. 6, hysteresis ring 323 is formed of a hysteresis material having characteristics for changing magnetic flux force with a phase delay with respect to a change of an external magnetic field and arranged such that the portion of a cylindrical wall 323*a* on the outer periphery side thereof is subjected to a brake action by coil yoke 325.

Coil yoke 325 as a whole is formed in an approximately cylindrical shape so as to surround electromagnetic coil 324, and the inner peripheral surface thereof is rotatably supported to a tip end of driven member 307 via bearing 328.

To a rear surface side of coil yoke 325, a pair of confronting surfaces 326, 327 are formed such that a magnetism coming-in portion and a magnetism going-out portion confront with each other across a cylindrical gap.

Figure 4:
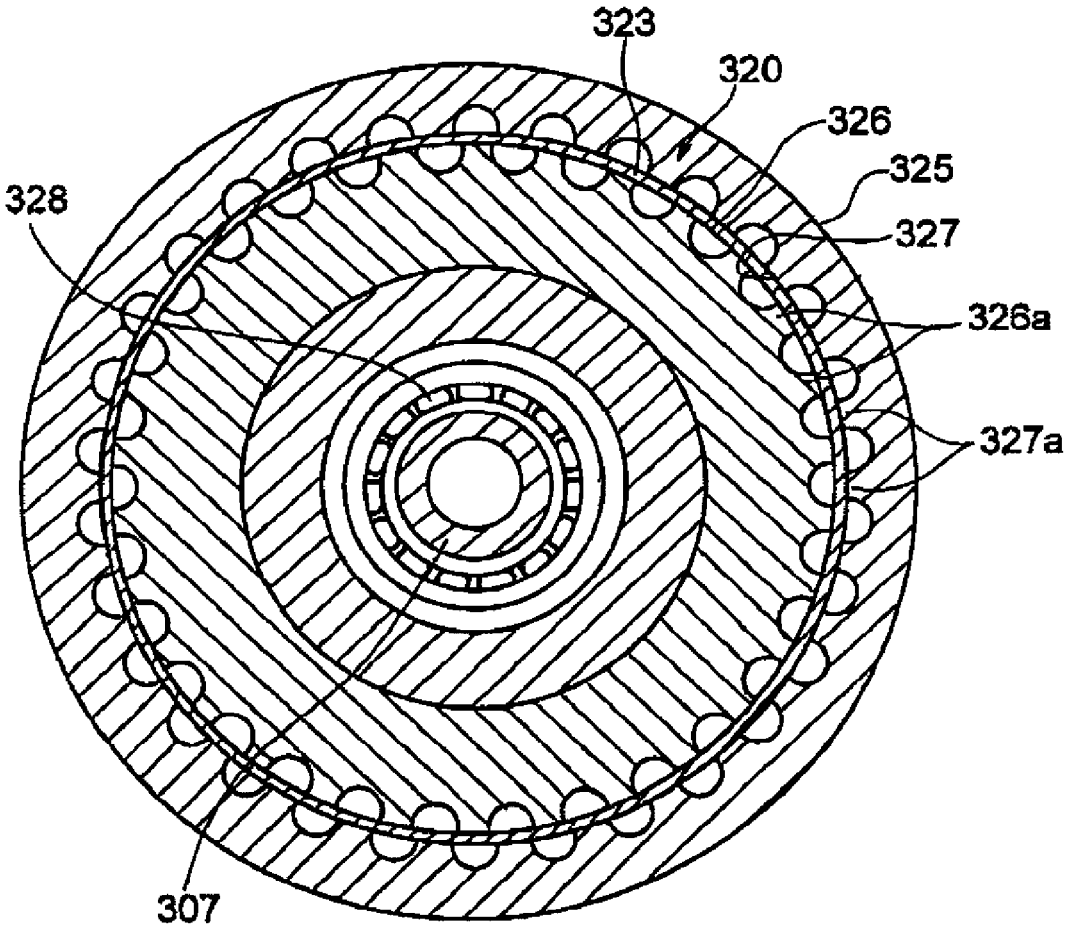
FIG. 4 is a sectional view taken along a line B-B of FIG. 2.
Figure 5:
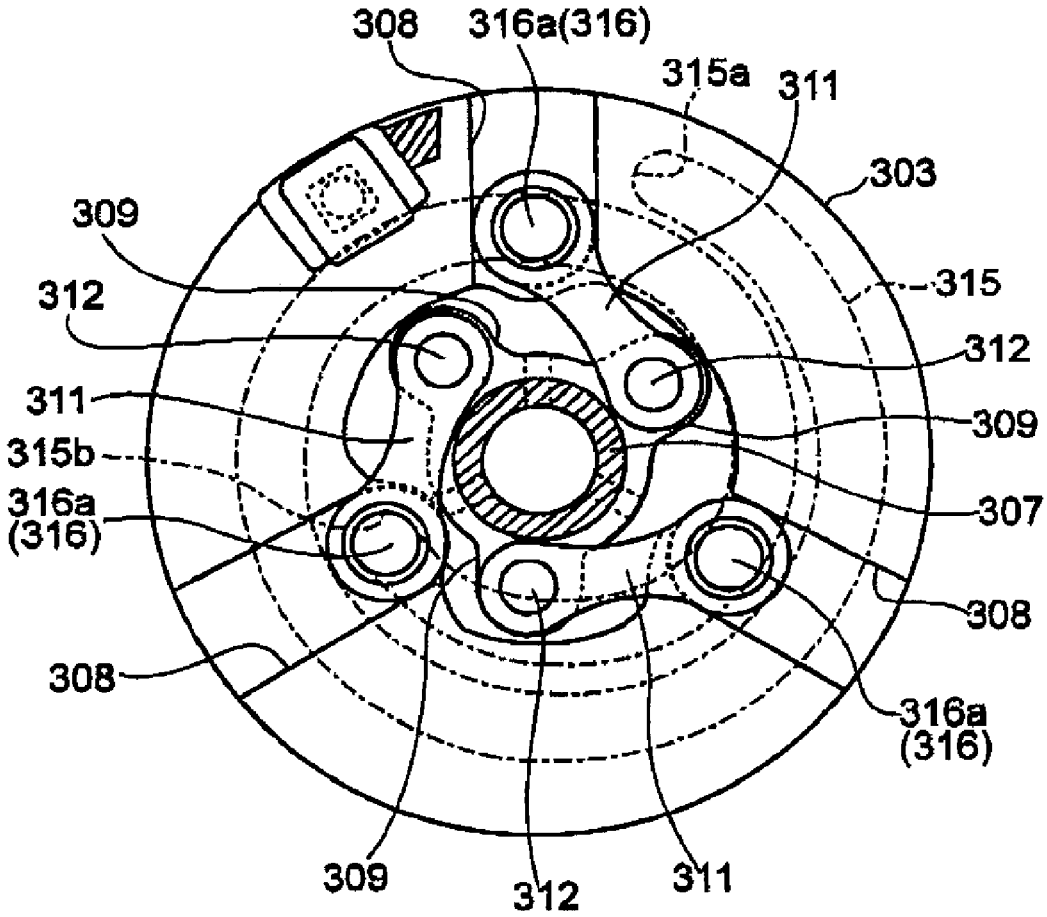
FIG. 5 is a sectional view taken along the line A-A of FIG. 2 and illustrates a state that valve timing is varied.

Further, as shown in FIG. 4, a plurality of concaves and convexes are continuously formed along a circumferential direction to each of both confronting surfaces 326, 327 of coil yoke 325, and convex portions 326*a*, 327*a* of the convexes form magnetic poles.

Then, convex portions 326*a* of one confronting surface 326 and convex portions 327*a* of the other confronting surfaces 327 are alternately disposed in the circumferential direction so that proximate convex portions 326*a*, 327*a* of confronting surfaces 326, 327 are dislocated in the circumferential direction.

Figure 7:
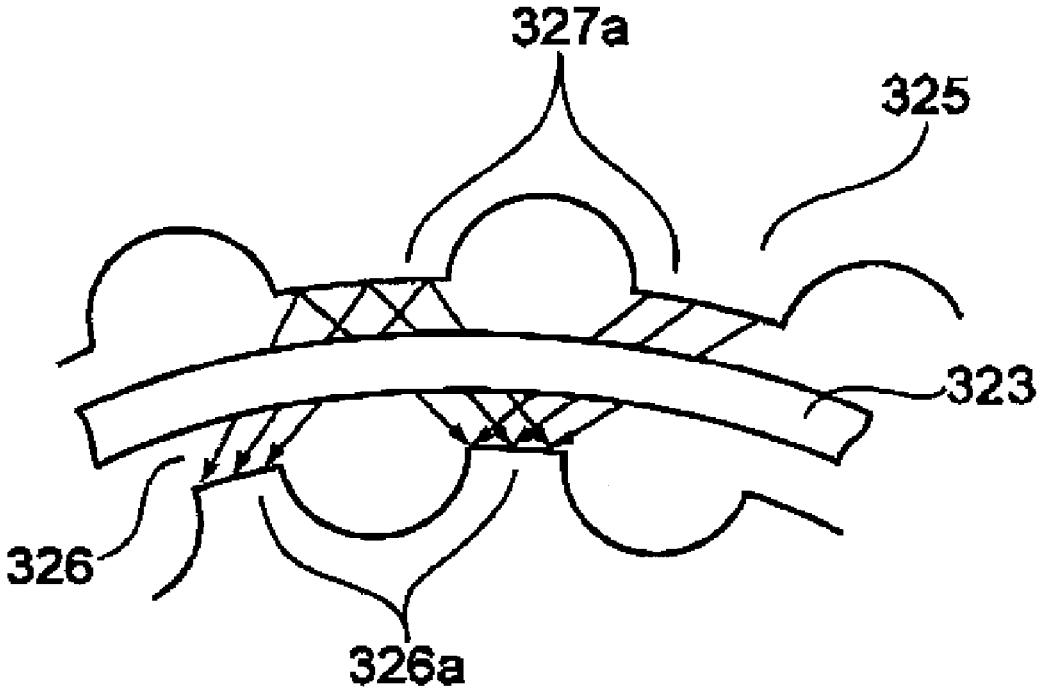
FIG. 7 is a sectional view illustrating a part of FIG. 4.

Accordingly, a magnetic field in a direction having inclination in the circumferential direction as shown in FIG. 7 is generated between proximate convex portions 326*a*, 327*a* of both confronting surfaces 326, 327 by exciting electromagnetic coil 24.

Cylindrical wall 323*a* of hysteresis ring 323 is interposed in the gap between both confronting surfaces 326, 327 without contacting therewith.

Hereinafter, a principle of operation of hysteresis brake 320 will be described referring to FIG. 8.

Figure 8:
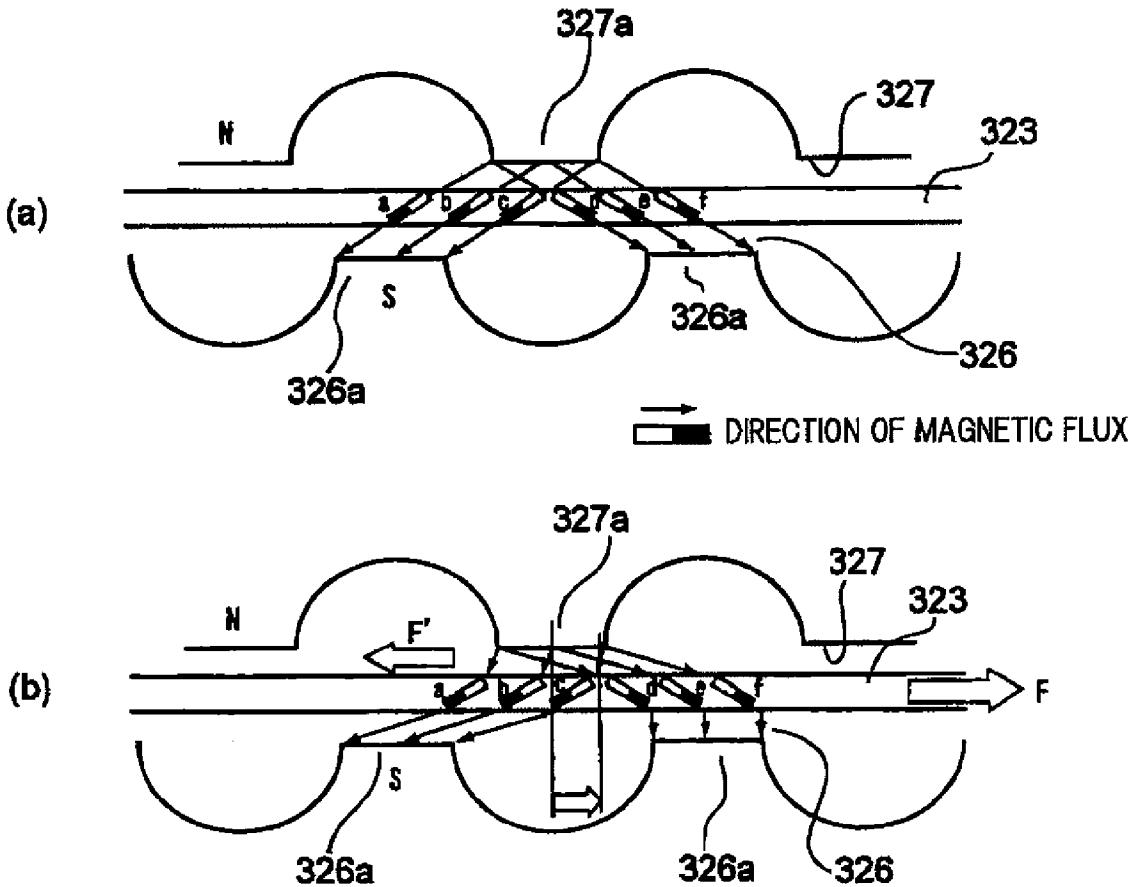
FIG. 8 is a schematic view of FIG. 7 illustrating magnetic flux (a) in an initial state and (b) when a hysteresis ring rotates.

Here, FIG. 8 shows a state that (a) a magnetic field is applied to hysteresis ring 323 first, and (b) hysteresis ring 323 is displaced from that state of (a).

In the state of FIG. 8(*a*), a flow of magnetic flux occurs in hysteresis ring 323 along the direction of the magnetic field of confronting surfaces 328, 327 of coil yoke 325, in other words, along the direction of the magnetic field traveling from convex portion 327*a* of confronting surface 327 to convex portion 326*a* of the other confronting surface 326.

When hysteresis ring 323 is moved by external force F applied thereto as shown in FIG. 8(*b*), hysteresis ring 323 is displaced in an external magnetic field. Thus, the magnetic flux in hysteresis ring 323 at the time has a phase delay and a direction inclining with respect to the magnetic field between confronting surfaces 326, 327.

Accordingly, a flow of the magnetic flux, which enters hysteresis ring 323 from convex portion 327*a* of confronting surface 327, and a flow of the magnetic flux, which travels from hysteresis ring 323 to convex portion 326*a* of the other confronting surface 326, are distorted. At the time, an attracting force for correcting the distortion of the flows of the magnetic flux acts between confronting surfaces 326, 327 and hysteresis ring 323 so as to act as brake drag F' for breaking hysteresis ring 323.

As described above, the hysteresis brake 320 generates brake force by the displacement between the direction of the magnetic flux in hysteresis ring 323 and the direction of the magnetic field between confronting surfaces 326, 327 when hysteresis ring 323 is displaced in the magnetic field.

The brake force has a value, which is approximately proportional to the strength of the magnetic field, that is, the magnitude of a magnetically excited current of electromagnetic coil 324 regardless of the rotation speed of hysteresis ring 323.

Since variable valve timing mechanism 113 is arranged such that when electromagnetic coil 324 of hysteresis brake 320 is deexcited, intermediate rotary body 318 is rotated to the maximum in an engine rotating direction with respect to drive ring 303 by the urging force of flat spiral spring 319 and engaging pins 316 are abutted against an outer periphery side end portion 315*a* of groove 315, and this state is made to a most retard angle position of a relative phase that can be varied in the mechanism (refer to FIG. 3).

When electromagnetic coil 324 is excited from the most retard angle position, brake force against the force of flat spiral spring 319 is applied to intermediate rotary body 318 so that intermediate rotary body 318 is rotated in a reverse direction with respect to drive ring 303. With this operation, the tip ends of links 311 are displaced along grooves 308 by that engaging pins 316 of the tip ends of links 311 are guided by grooves 315, and thereby the angle at which drive ring 303 is assembled to driven member 307 is varied to an advance angle side by the action of link 11.

When the brake force is increased by increasing the exciting current of electromagnetic coil 324, engaging pins 316 are abutted against inner peripheral side end surfaces 315*b* of grooves 315. This state becomes a most advance angle position of the relative phase that can be varied in the mechanism (refer to FIG. 5).

Further, when the brake force is reduced from the state of the most advance angle position by reducing the exciting current of electromagnetic coil 324, intermediate rotary body 318 is rotated in a forward direction by the urging force of flat spiral spring 319 and links 311 are swung by engaging pins 316 guided by grooves 315, thereby the angle at which drive ring 303 is assembled to driven member 307 is varied to a retard angle side.

As described above, variable valve timing mechanism 113 is a mechanism for varying the rotating phase of camshaft 134 with respect to crank shaft 120, and the rotating phase is continuously varied by controlling the brake force of hysteresis brake 320 by controlling the value of the exciting current of electromagnetic coil 324. As a result, the rotating phase can be maintained by the balance of the force of flat spiral spring 319 and the brake force of hysteresis brake 320.

It is apparent that variable valve timing mechanism 113 is not limited to that having the mechanism described based on FIGS. 2 to 8, and a known variable valve timing mechanism which varies the valve timing by applying brake torque on a camshaft likewise may be employed.

As the variable valve timing mechanism for applying the brake torque to the camshaft, there are mechanisms, which are disclosed in, for example, Japanese Laid-Open (Kokai) Patent Application Publication Nos. 2003-129806 and 2001-241339, and the like.

The variable valve timing mechanism disclosed in Japanese Laid-Open (Kokai) Patent Application Publication No. 2003-129806 has a first electromagnetic brake for an advance angle and a second electromagnetic brake for a retard angle and applies brake force acting in an advance angle direction and brake force acting in a retard angle direction to an assembly angle operation mechanism similar to the mechanism shown in FIGS. 2 to 5.

Further, the variable valve timing mechanism disclosed in Japanese Laid-Open (Kokai) Patent Application Publication No. 2001-241339 is such a mechanism that it rotates a drum relatively to a pulley by applying thereon a friction break, which is generated by a magnetic field of a first electromagnetic solenoid to thereby vary the rotating phase of the camshaft relative to the pulley, and permits the drum to be rotated relatively to the pulley by a magnetic field generated by a second electromagnetic solenoid, so that a phase is maintained by placing the second electromagnetic solenoid in a non-energization state.

Further, variable valve timing mechanism 113 is not limited to the mechanism for varying the rotating phase of the camshaft by applying the brake torque on the camshaft and may be a variable valve timing mechanism using an electrically driven motor as a drive source disclosed in, for example, Japanese Laid-Open (Kokai) Patent Application Publication No. 2007-262914.

FIGS. 9 to 14 show an example of a variable valve timing mechanism using the electrically driven motor as a drive source.

Figure 9:
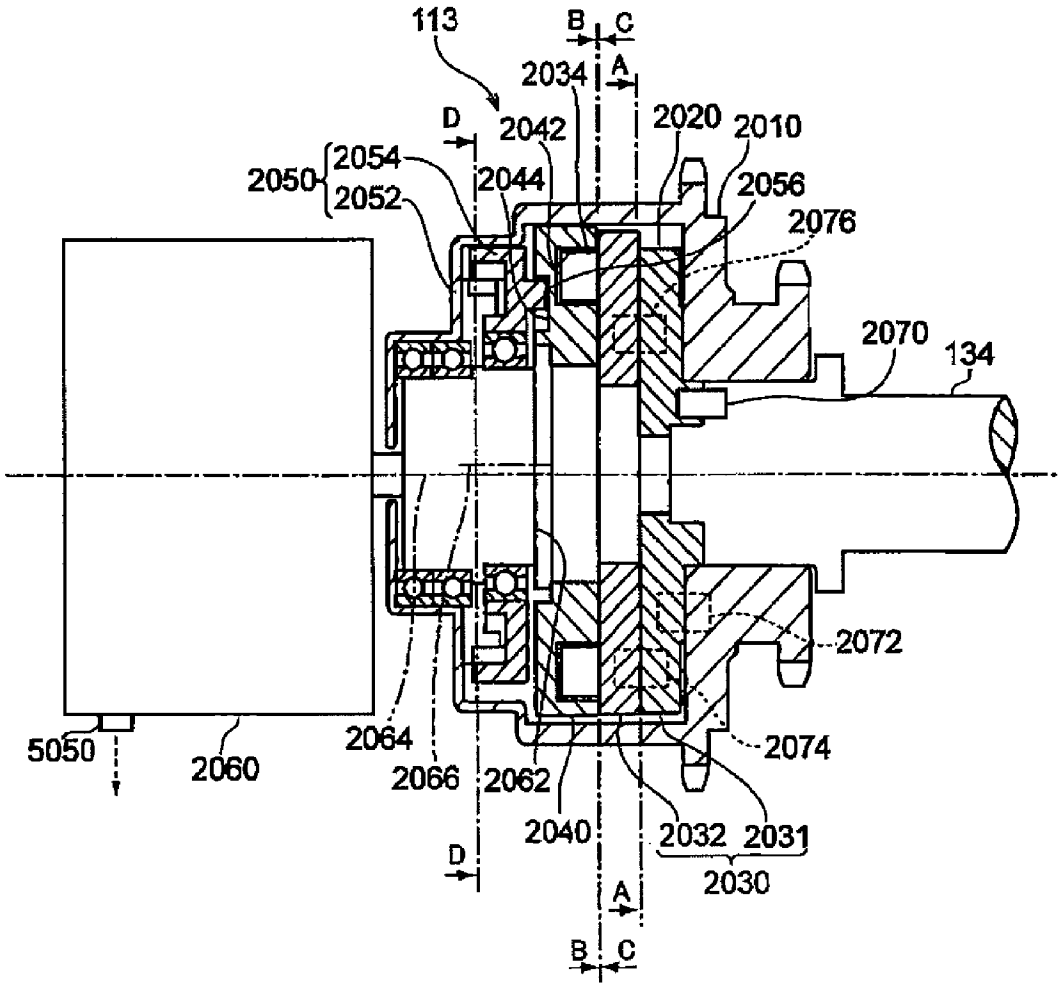
FIG. 9 is a sectional view illustrating a motor type variable valve timing mechanism of the embodiment.
Figure 10:
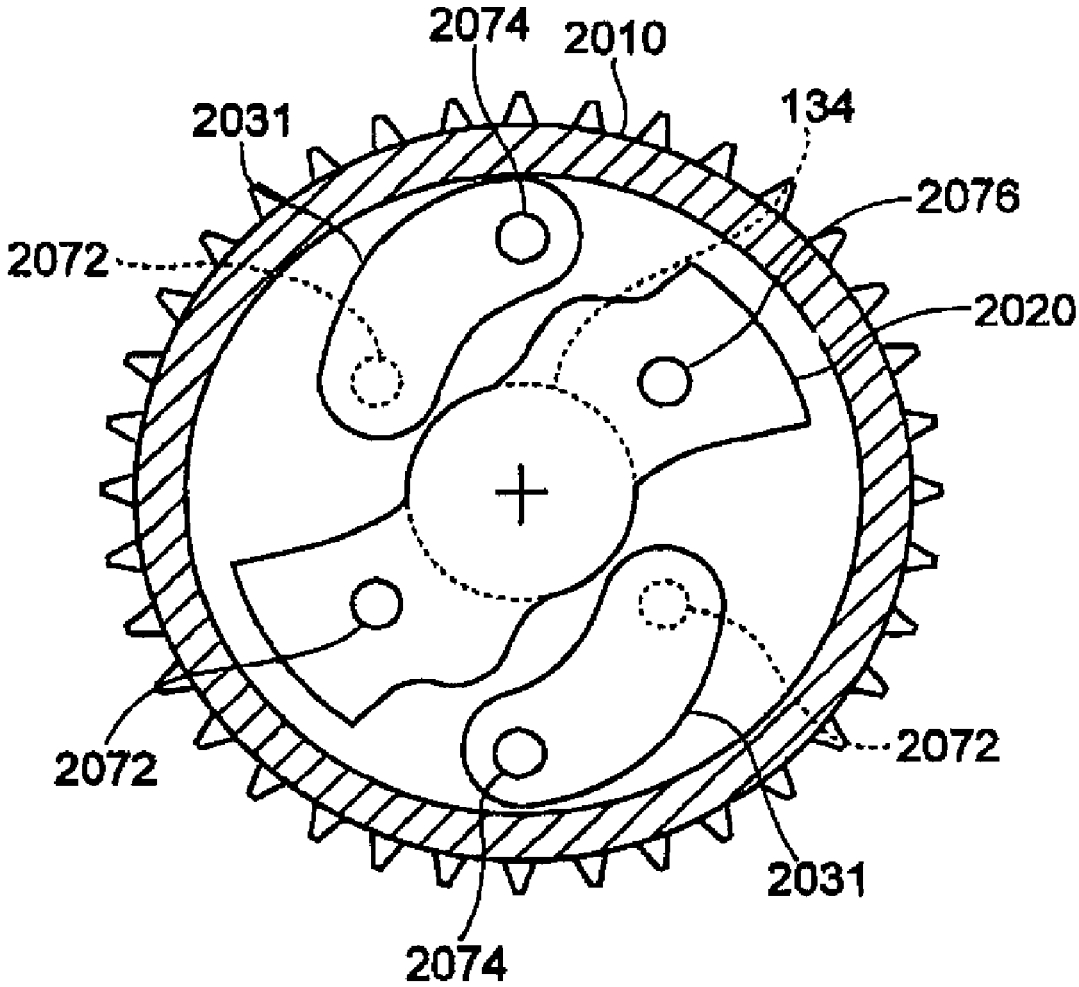
FIG. 10 is a sectional view taken along a line A-A of FIG. 9.

Variable valve timing mechanism 113 shown in FIG. 9, is composed of a sprocket 2010, a cam plate 2020, link mechanisms 2030, a guide plate 2040, a reducer 2050, and an electrically driven motor 2060.

Sprocket 2010 is coupled with a crank shaft 120 via a chain and the like.

An intake camshaft 134 is disposed coaxially with a rotating axis of sprocket 2010 so that it can rotate relatively to sprocket 2010.

Cam plate 2020 is coupled with intake camshaft 134 via a pin (1) 2070 and rotates in sprocket 2010 integrally with intake camshaft 134.

Here, cam plate 2020 may be formed integrally with intake camshaft 134.

Link mechanisms 2030 are composed of arms (1) 2031 and arms (2) 2032.

As shown in FIG. 101 a pair of arms (1) 2031 are disposed in sprocket 2010 so that they have point symmetry with respect to a rotating axis of intake camshaft 134, and respective arms (1) 2031 are coupled with sprocket 2010 so that they can swing about pins (2) 2072.

Figure 11:
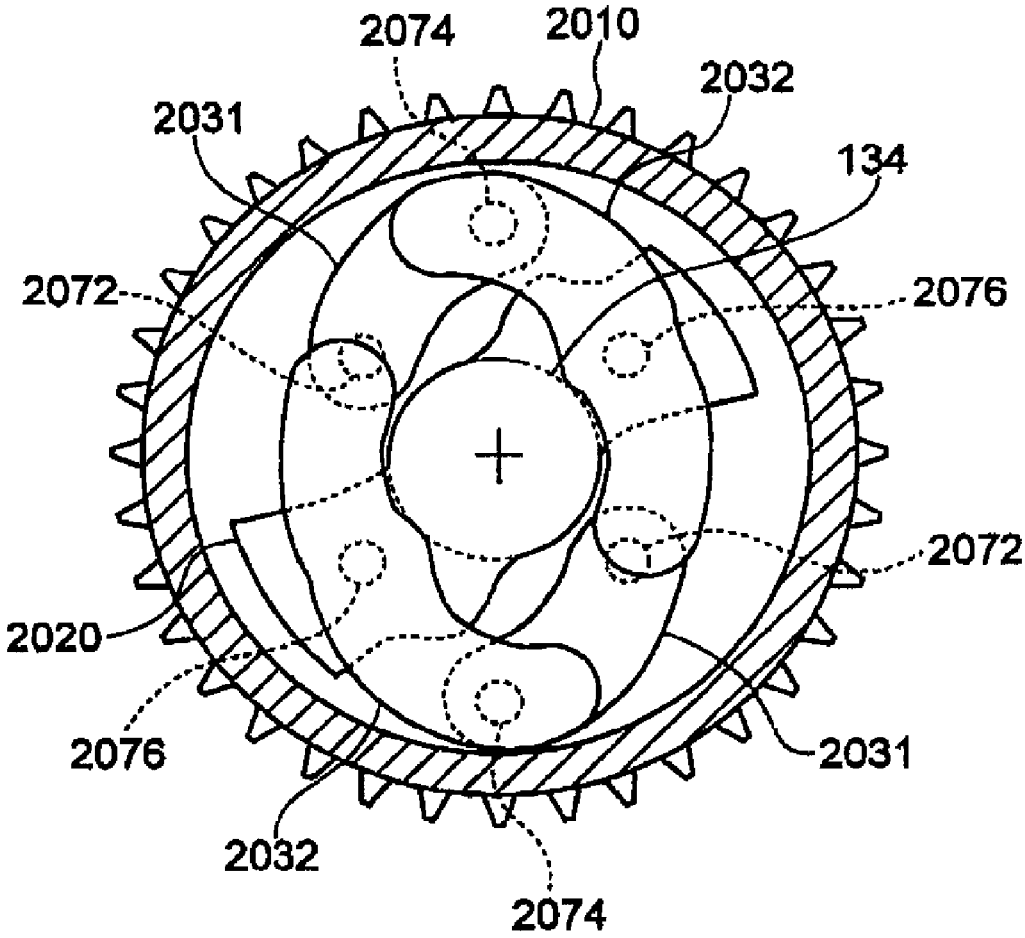
FIG. 11 is a sectional view taken along a line B-B of FIG. 9.
Figure 12:
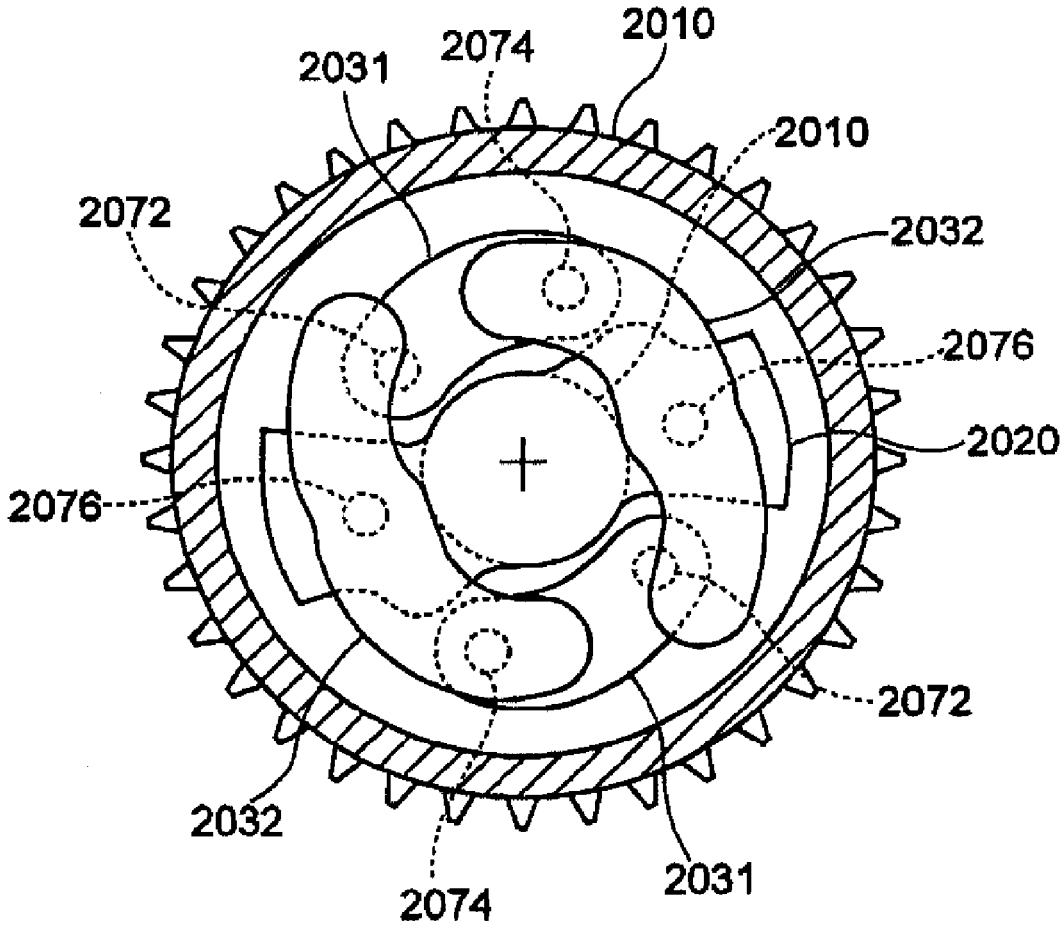
FIG. 12 is a sectional view taken along the line B-B of FIG. 9 and illustrates a state of a phase which is different from that of FIG. 11.

As shown in FIGS. 11 and 12, arms (1) 2031 are couple with cam plate 2020 via arms (2) 2032.

Arms (2) 2032 are supported so that they can swing about pins (3) 2074 with respect to arms (1) 2031, and further arms (2) 2032 are supported so that they can swing about pins (4) 2076 with respect to cam plate 2020.

Intake camshaft 134 is rotated relatively to sprocket 2010 by a pair of link mechanisms 2030, so that the phase of intake valve 105 is changed.

Control pins 2034 are disposed to the surfaces of respective link mechanisms 2030 on guide plate 2040 side coaxially with pins (3) 2074 and slide in guide grooves 2042 formed in guide plate 2040.

Respective control pins 2034 move in a radial direction by sliding in guide grooves 2042 of guide plate 2040, and intake camshaft 134 rotates relatively to sprocket 2010 by that respective control pins 2034 move in the radial direction.

Figure 13:
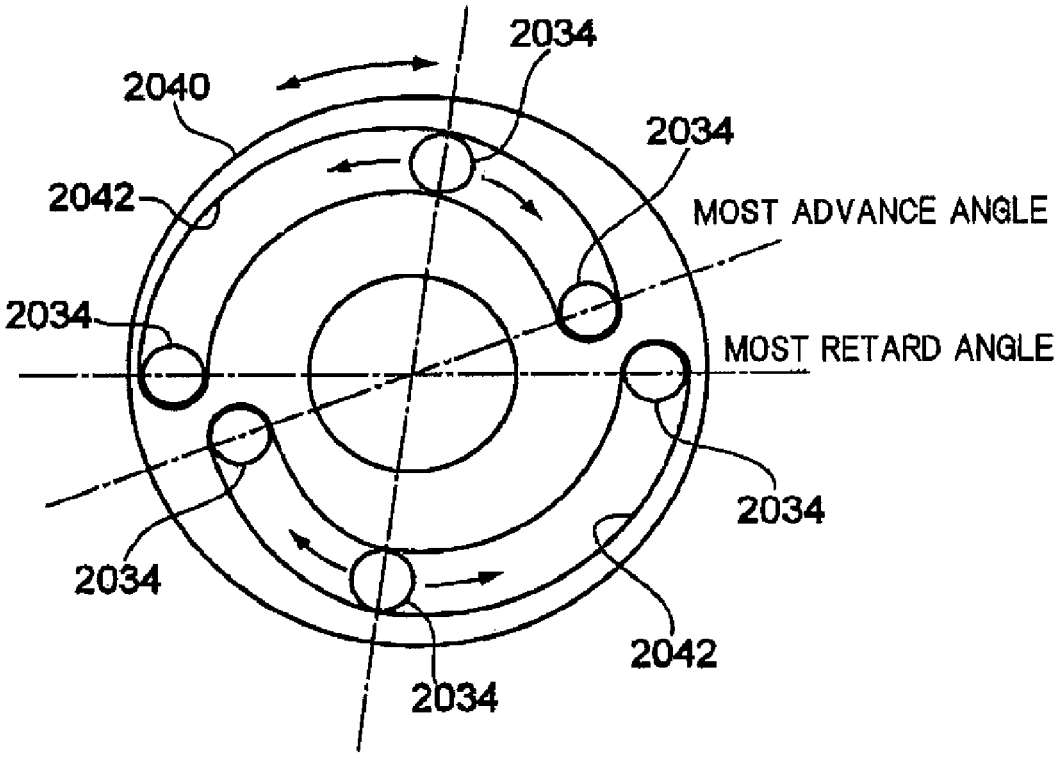
FIG. 13 is a sectional view taken along a line C-C of FIG. 9.

As shown in FIG. 13, each of guide grooves 2042 is formed in a swirl shape so that respective control pins 2034 move in the radial direction by the rotating movement of guide plate 2040.

As control pins 2034 are more away from the axial center of guide plate 2040, the valve timing of intake valve 105 (phase during an open period) is more retarded.

That is, the amount of variation of valve timing is set to an amount of action of link mechanisms 2030 due to the change of control pins 2034 in the radial direction.

As shown in FIG. 131 when control pins 2034 are abutted against edges of guide grooves 2042, the actions of link mechanisms 2030 are restricted, thereby a state that control pins 2034 are abutted against the edges of groove 2042 is placed in a most retard angle state or in a most advance angle state of valve timing.

In guide plate 2040, a plurality of concave portions 2044 are formed on the surface thereof on the reducer 2060 side, to couple guide plate 2040 with reducer 2050.

Reducer 2050 is composed of an external-tooth gear 2052 and an internal-tooth gear 2054, and external-tooth gear 2052 is fixed to sprocket 2010 so that it rotates integrally with sprocket 2010.

In internal-tooth gears 2054, there are formed a plurality of convex portions 2056, which are accommodated in concave portions 2044 of guide plate 2040. Further, internal-tooth gear 2054 is supported so that it can rotate about a decentering axis 2066 of a coupling 2062 formed so as to be decentered with respect to an axial center 2064 of an output axis of an electrically driven motor 2060.

Figure 14:
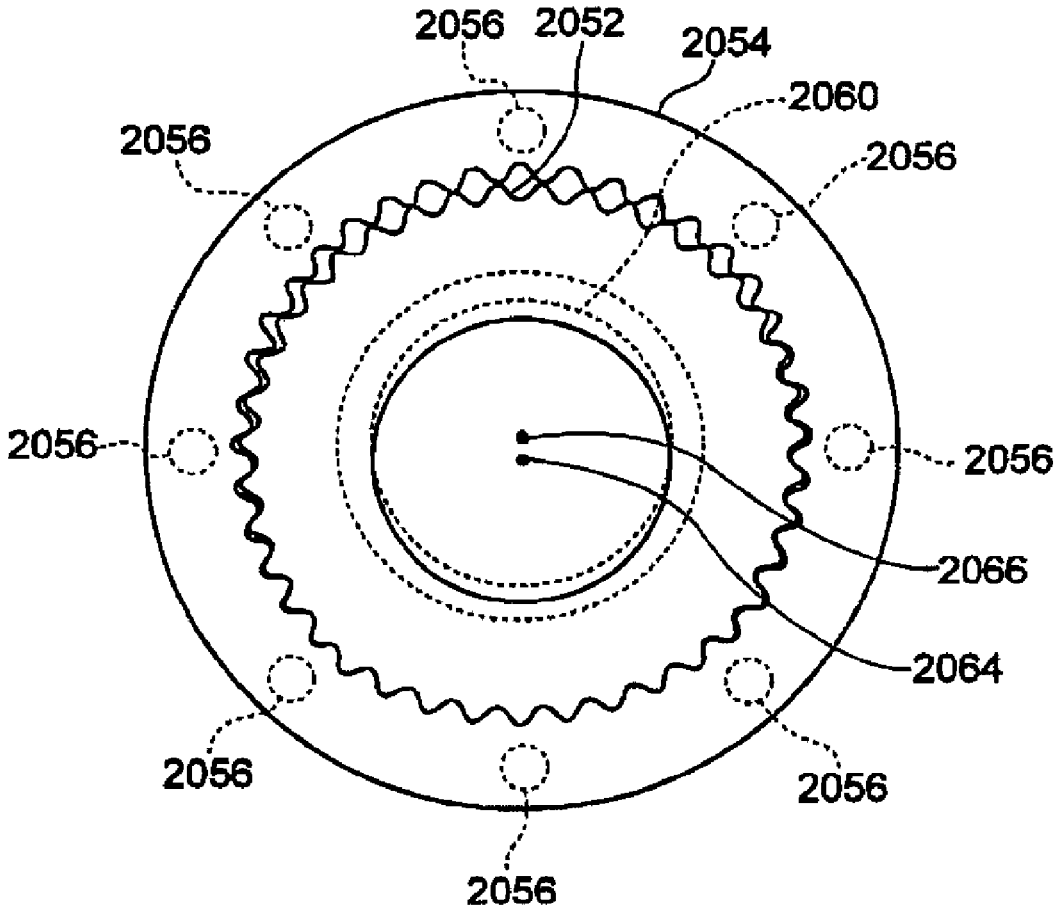
FIG. 14 is a sectional view taken along a line D-D of FIG. 9.

As shown in FIG. 14, internal-tooth gear 2054 is disposed such that several teeth of a plurality of teeth thereof are meshed with external-tooth gear 2052.

When the rotation speed of the output axis of electrically driven motor 2060 is the same as that of sprocket 2010, coupling 2062 and internal-tooth gear 2054 rotate at the same rotation speed as that of external-tooth gear 2052 (sprocket 2010). In this case, guide plate 2040 rotates at the same rotation speed as that of sprocket 2010, and thereby the rotating phase of intake camshaft 134 is maintained with respect to crank shaft 120.

In contrast, when coupling 2062 is rotated relatively to external-tooth gear 2052 about axial center 2064 by electrically driven motor 2060, internal-tooth gear 2054 rotates in its entirety about axial center 2064 as well as internal-tooth gear 2054 rotates on its axis about decentering axis 2066.

Guide plate 2040 is rotated relatively to sprocket 2010 by the rotation of internal-tooth gear 2054, so that the rotating phase of intake camshaft 134 relative to crank shaft 120 and thus the valve timing of intake valve 105 are varied.

When the valve timing of intake valve 105 is advanced, electrically driven motor 2060 is operated. When guide plate 2040 is rotated relatively to sprocket 2010 and the valve timing is retarded, the output axis of electrically driven motor 2060 is rotated relatively to sprocket 2010 in a direction reverse to that of when the valve timing is advanced. As a result, the valve timing of intake valve 105 is continuously varied.

Engine control unit 114 controls the valve timing of intake valve 105 by controlling a direction, in which a battery voltage is applied to the electrically driven motor 2060, and a drive current. In detail, engine control unit 114 varies the valve timing of intake valve 105 by changing the manipulated variable of a switching element for controlling a power supply voltage (battery voltage) to electrically driven motor 2060.

Figure 15:
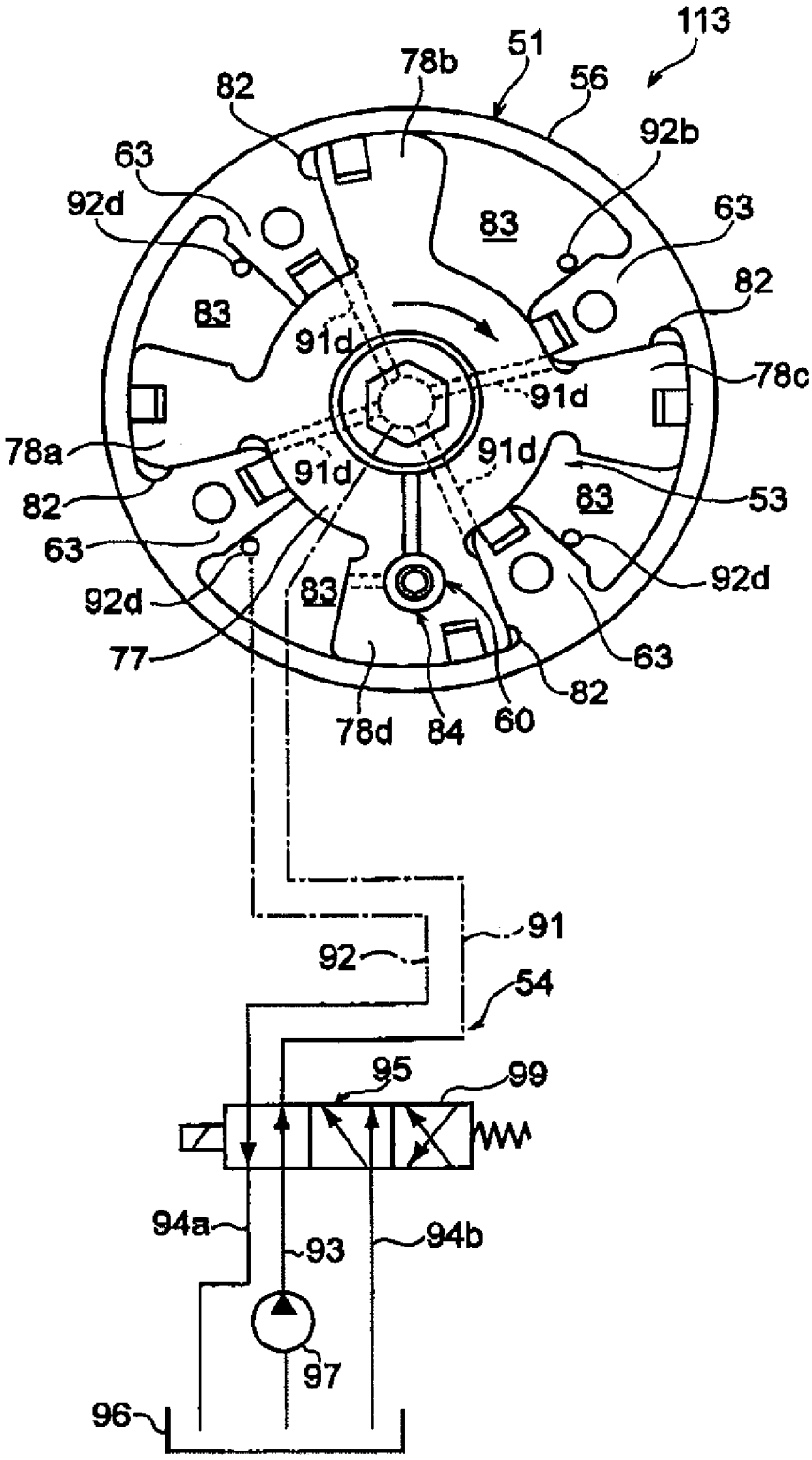
FIG. 15 is a sectional view illustrating a hydraulic type variable valve timing mechanism of the embodiment of the present invention.

Further, there is a vane type mechanism capable of using a mechanism using hydraulic pressure as a drive source as variable valve timing mechanism 113, and as the hydraulic type variable valve timing mechanism as shown, for example, in FIG. 15 (refer to Japanese Laid-Open (Kokai) Patent Application Publication No. 2005-036760).

The vane type variable valve timing mechanism 113 is provided with a cam sprocket 51 to which the rotational driving force of a crank shaft 120 is transmitted through a timing chain, a rotary member 53 fixed to an end of intake camshaft 13 and rotatably accommodated in cam sprocket 51, a hydraulic circuit 54 for rotating rotary member 53 relatively to cam sprocket 51, and a lock mechanism 60 for locking a relative rotating position of cam sprocket 51 and rotary member 53 at a predetermined position The cam sprocket 51 is composed of a not-shown rotating unit having a tooth portion meshed with the timing chain and formed around an outer periphery thereof, a housing 56 disposed forward of the rotating unit for rotatably accommodating rotary member 53, and a not-shown front cover and a not shown rear cover for closing front and rear openings of housing 56.

Housing 56 is formed in a cylindrical shape with both the front and rear ends opened and has four partition walls 63 projecting in a peripheral direction at intervals of 90° from an inner peripheral surface of housing 56.

Rotary member 53 is fixed to a front end of intake camshaft 13, and four vanes 78*a*, 78*b*, 78*c*, 78*d* are disposed on an outer peripheral surface of an annular base portion 77 at intervals of 90 °.

First to fourth vanes 78*a* to 78*d* are disposed between respective partition walls 63 so that spaces sandwiched by partition walls 63 are partitioned in front of and behind a rotating direction, and thereby advance angle side hydraulic chambers 82 and retard angle side hydraulic chambers 83 are formed.

In lock mechanism 60, a lock pin 84 is insert-fitted into a not-shown engaging hole at a most retard angle position of rotary member 53.

Hydraulic circuit 54 has two systems of hydraulic paths, that is, a first hydraulic path 91 for supplying and discharging hydraulic pressure to and from advance angle side hydraulic chambers 82, and a second hydraulic path 92 for supplying and discharging hydraulic pressure to and from retard angle side hydraulic chambers 83. A supply path 93 and drain paths 94*a*, 94*b* are connected to both hydraulic paths 91, 92 via hydraulic control valve 95.

In supply path 93, there is disposed an oil pump 97 for supplying oil in an oil pan 96 under pressure, and downstream ends of drain paths 94*a*, 94*b* communicate with oil pan 96.

First hydraulic path 91 is formed approximately radially in a base portion 77 of rotary member 53 and connected to four branch paths 91*d* communicating with respective advance angle side hydraulic chambers 82, and second hydraulic path 92 is connected to four oil holes 92*d* which open to respective retard angle side hydraulic chambers 83.

Hydraulic control valve 95 is arranged such that a spool valve body disposed thereinside switches respective hydraulic pressure paths 91, 92 and path 93 and drain paths 94*a*, 94*b*.

Engine control unit 114 controls the valve timing of intake valve 105 by controlling a duty ratio of when energization of an electromagnetic actuator 99 for driving hydraulic control valve 95 is switched.

When, for example, the duty ratio is set to 0%, a hydraulic fluid supplied from oil pump 47 under pressure is supplied to retard angle side hydraulic chambers 83 through second hydraulic path 92 as well as a hydraulic fluid in advance angle side hydraulic chambers 82 is discharged into oil pan 96 from first drain path 94*a* passing through first hydraulic path 91.

Accordingly, the internal pressure in retard angle side hydraulic chambers 83 increases, the internal pressure in advance angle side hydraulic chambers 82 decreases, and thus rotary member 53 is rotated to a retard angle side via vanes 78*a* to 78*b* in a maximum magnitude with a result that the valve timing of intake valve 105 is placed in a most retard angle state In contrast, when the duty ratio is set to 100%, the hydraulic fluid is supplied into advance angle side hydraulic chambers 82 passing through first hydraulic path 91 as well as the hydraulic fluid in retard angle side hydraulic chambers 83 is discharged into oil pan 96 through second hydraulic path 92 and second drain path 94*b*, and thus the internal pressure of a retard angle side hydraulic chamber 83 is reduced as well as the internal pressure in pressure advance angle side hydraulic chamber 82 is increased.

Accordingly, rotary member 53 is rotated to an advance angle side in a maximum magnitude through vanes 78*a* to 78*d*, and thus the valve timing of intake valve 105 is placed in a maximum advance angle state.

As described above, the phase of intake camshaft 13 relative to crank shaft 120 continuously varies from a most retard angle position to a most advance angle position in a range in which vane 78*a* to 78*d* can relatively rotates in housing 56, and accordingly the valve timing of intake valve 105 continuously varies.

As described above, variable valve timing mechanism 113 is controlled by the manipulated variable applied from engine control unit 114, and hereinbelow, a calculation function of the manipulated variable in engine control unit 114 will be described referring to a block diagram of FIG. 16.

Figure 16:
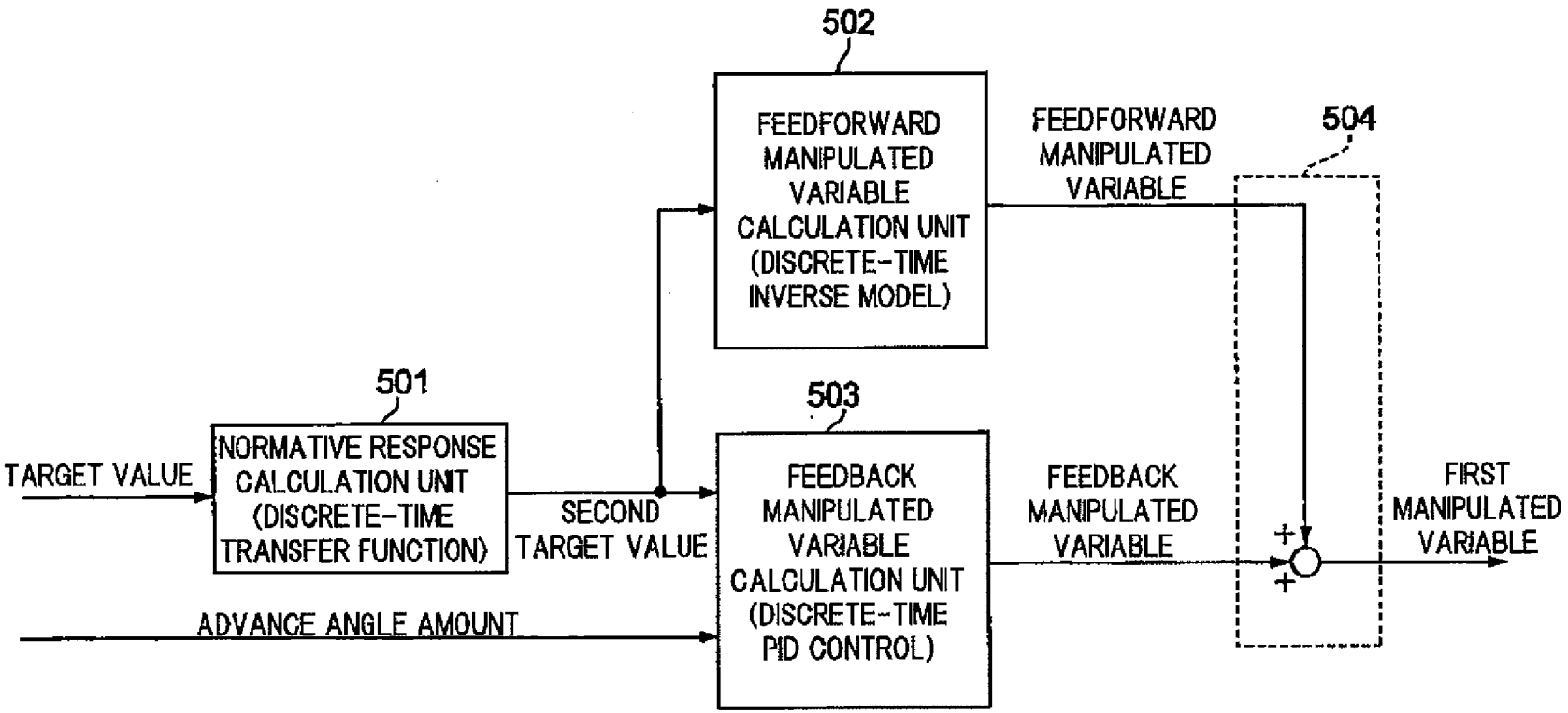
FIG. 16 is a block diagram illustrating a unit for calculating a manipulated variable of the embodiment of the present invention.

In FIG. 16, a target value of the valve timing is calculated from an operating state of an engine 101, in more specific, an engine load, an engine rotation speed, an ON/OFF state of a start switch, and the like.

Further, the target value is calculated, for example, as an advance angle amount from the most retard angle position.

The target value is output to a normative response calculation unit 501. Here, a second target value, which follows and changes with a normative response with respect to a change of the target value is calculated by using a transfer function which prescribes a desired response.

The transfer function is previously set based on response characteristics of variable valve timing mechanism 113, a response request for changing the valve timing at the engine start, and the like.

The second target value is output to a feedforward manipulated variable calculation unit 502 and to a feedback manipulated variable calculation unit 503.

Feedforward manipulated variable calculation unit 502 calculates a feedforward manipulated variable FF required to change the valve timing along the second target value based on a mathematical inverse model of variable valve timing mechanism 113.

Feedback manipulated variable calculation unit 503 calculates a feedback manipulated variable FB by a PID control based on a difference between an advance angle amount of actual valve timing and the second target value. The advance angle amount of actual valve timing is detected from a phase difference between a reference crank angle signal REF and a cam signal CAM.

In an addition unit 504, a first manipulated variable is obtained by adding the feedforward manipulated variable FF and the feedback manipulated variable FB.

Then, the first manipulated variable as an output from the addition unit 504 is output to an actuator of variable valve timing mechanism 113 such as an electromagnetic coil 324 and the like.

Figure 17:
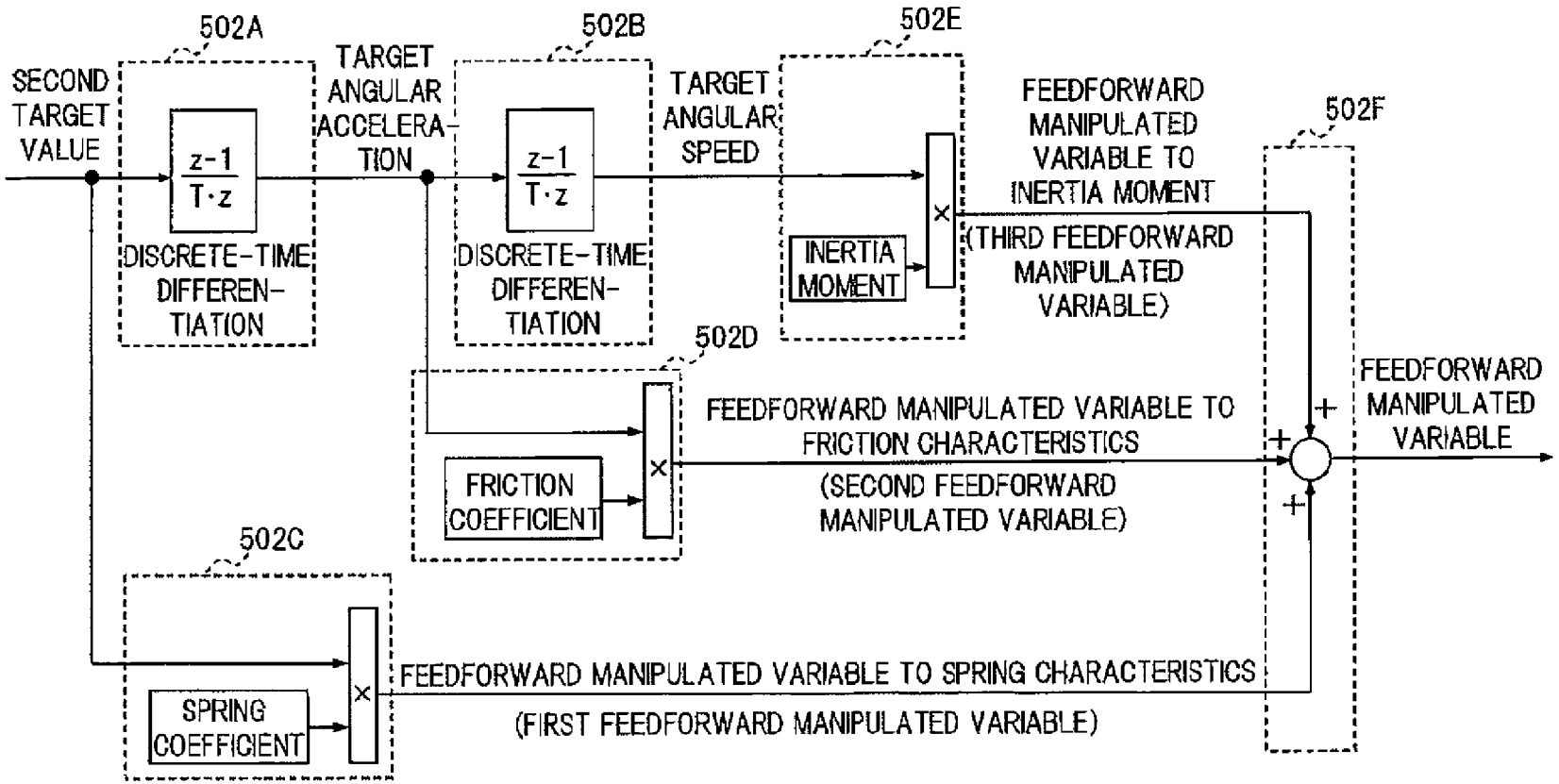
FIG. 17 is a block diagram illustrating a unit for calculating a feedforward manipulated variable of the embodiment of the present invention.

FIG. 17 is a block diagram showing feedforward manipulated variable calculation unit 502 in detail.

To a first derivative unit 502A, the second target value is input, and in first derivative unit 502A, a target angular speed is calculated by differentiating the second target value.

The target angular speed is output to a second derivative unit 502B and differentiated by the second derivative unit 502B, thereby calculating a target angular acceleration.

Further, the second target value is input to a first FF calculation unit 502C and multiplied by a previously stored spring coefficient, thereby calculating a feedforward manipulated variable (first feedforward manipulated variable), with respect to spring characteristics.

The target angular speed is input to a second FF calculation unit 502D, and a previously stored friction coefficient is multiplied by the target angular speed, thereby calculating a feedforward manipulated variable (second feedforward manipulated variable) with respect to friction characteristics.

The target angular acceleration is input to a third FF calculation unit 502E, and a previously stored inertia moment is multiplied by the target angular acceleration, thereby calculating a feedforward manipulated variable (third feedforward manipulated variable) with respect to the inertia moment.

As described above, feedforward manipulated variable calculation unit 502 specifies a model of variable valve timing mechanism 113 by the spring coefficient, the friction coefficient, and the inertia moment, and sets the manipulated variables required to cause the valve timing to change to follow up the second target value based on the reference model.

However, it is apparent that parameters for specifying the model of variable valve timing mechanism 113 is not limited to the spring coefficient, the friction coefficient, and the inertia moment.

Then, in an addition unit 502F, the feedforward manipulated variable (first feedforward manipulated variable) with respect to the spring characteristics, the feedforward manipulated variable (second feedforward manipulated variable) with respect to the friction characteristics, and the feedforward manipulated variable (third feedforward manipulated variable) with respect to the inertia moment are added, to thereby obtain a final feedforward manipulated variable FF.

Figure 18:
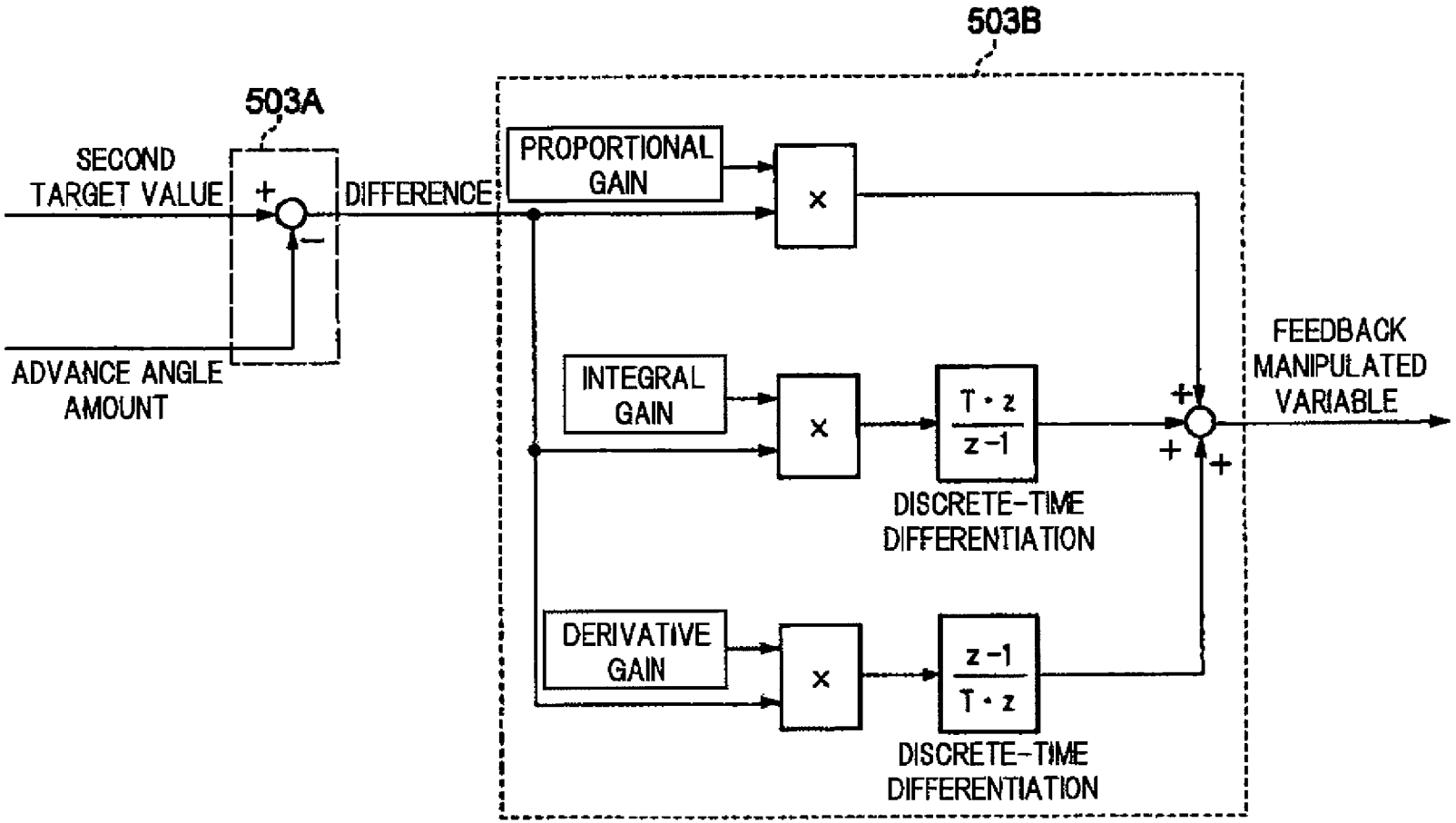
FIG. 18 is a block diagram illustrating a unit for calculating the feedback manipulated variable of the embodiment of the present invention.

FIG. 18 is a block diagram showing feedback manipulated variable calculation unit 503 in detail.

A subtraction unit 503A calculates the difference between an actual valve timing (advance angle amount), which is detected from the phase difference between the reference crank angle signal REF and the cam signal CAM, and the second target value.

The difference is output to a PID control unit 503B. PID control unit 503B calculates: a proportional component by multiplying the difference by a proportional gain; an integral component by multiplying the deviation by an integral gain; and a derivative component by multiplying the difference by a derivative gain, and then adds the proportional, integral, and derivative components, to thereby output an obtained result of addition as a final feedback manipulated variable FB.

The feedback manipulated variable FB can be calculated based on a sliding mode.

Incidentally, when the setting of the valve timing of intake valve 105 in an engine stop state is different from the target value of when an engine 101 starts, a start period of time (time required to start the engine) can be reduced by promptly varying the valve timing from the setting in the stop state to the target value of when engine 101 starts.

Figure 19:
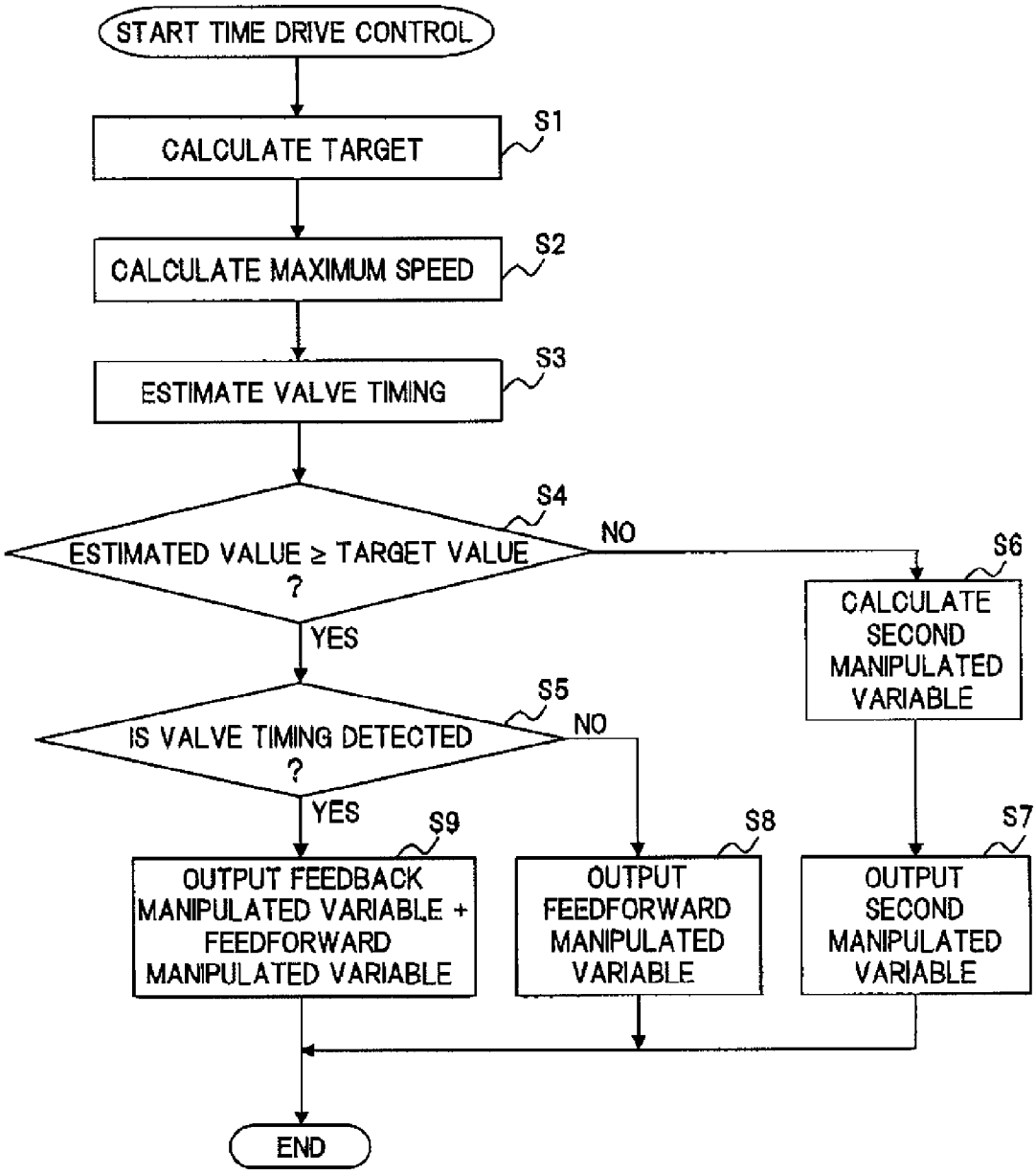
FIG. 19 is a flowchart illustrating a first embodiment of a control of the variable valve timing mechanism according to the present invention.

Thus, in the present embodiment, when engine 101 starts, the manipulated variable of variable valve timing mechanism 113 is output according to a flowchart of FIG. 19 in place of a control for outputting the first manipulated variable which is a value obtained by adding the feedforward manipulated variable FF and the feedback manipulated variable FB.

The flowchart of FIG. 19 shows a control of variable valve timing mechanism 113 which is executed transiently from a time at which engine 101 starts, that is, a time at which variable valve timing mechanism 113 starts to be driven, to a time at which the first manipulated variable, which is obtained by adding the addition amount of the feedforward manipulated variable FF and the feedback manipulated variable FB is output.

Figure 20:
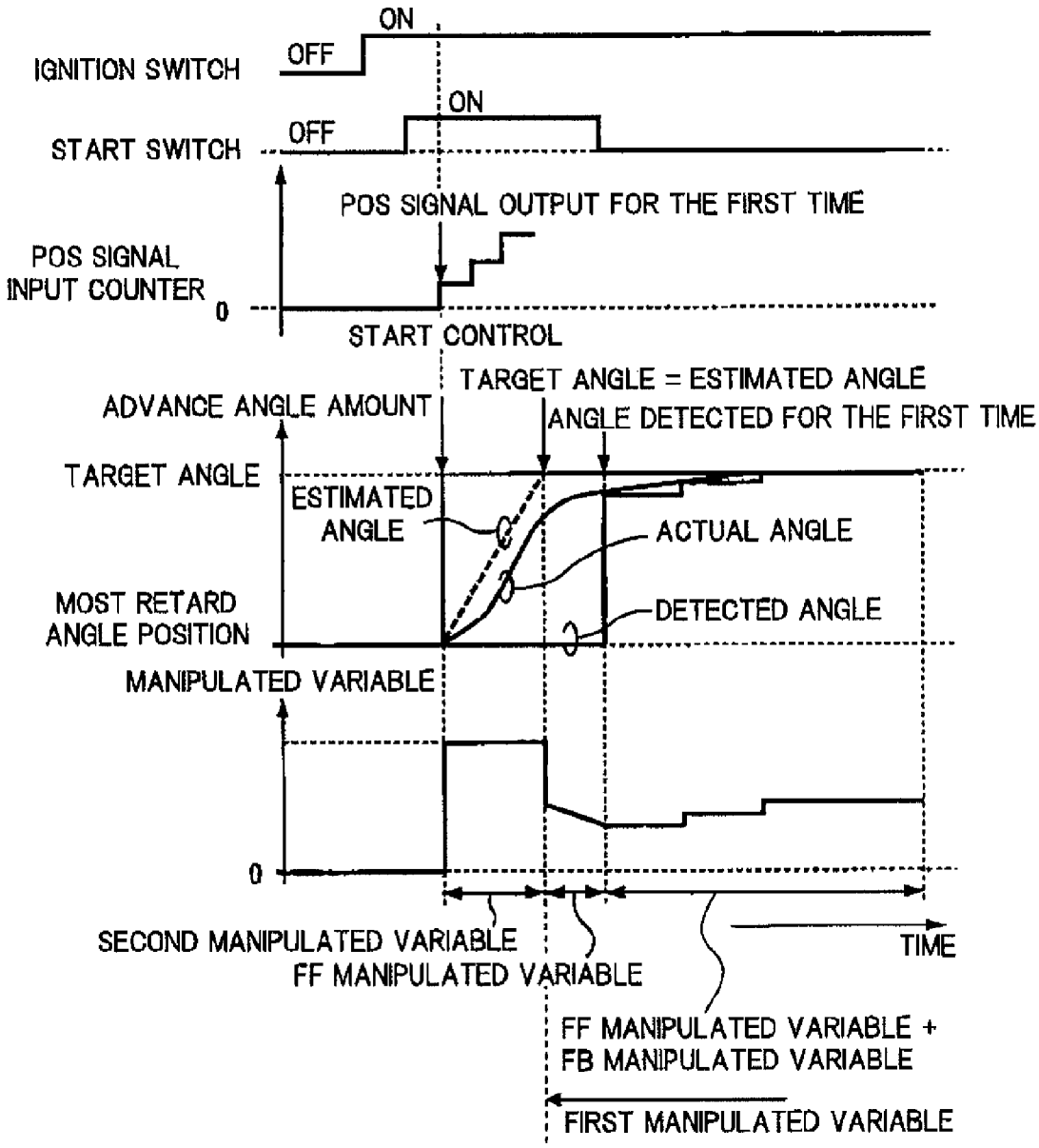
FIG. 20 is a time chart illustrating a change of valve timing and the manipulated variable of the first embodiment.

A time chart of FIG. 20 shows a change of the valve timing of intake valve 105 and a change of the manipulated variable of the variable valve timing mechanism 113, caused by the control shown in flowchart of FIG. 19.

As shown in FIG. 20, in the present embodiment, a starter switch is turned on after an ignition switch is turned on. As a result, the manipulated variable starts to be output to variable valve timing mechanism 113 at timing at which engine 101 starts to rotate.

Specifically, the manipulated variable begins to be output to variable valve timing mechanism 113 at timing at which a unit angle signal POS is output from crank angle sensor 117 for the first time.

Accordingly, it is assumed that a routine shown in the flowchart of FIG. 19 is started after the unit angle signal POS is issued, and thereafter it is repeatedly executed each predetermined time.

However, the routine shown in the flowchart of FIG. 19 may be started when the ignition switch is turned on or when the starter switch is turned on and thereafter repeatedly executed each predetermined time.

First, at step S1, the target value of the advance angle amount of the valve timing is set based on engine operating states, such as an engine load, an engine rotation speed, an engine temperature, the ON/OFF states of the starter switch, and the like.

In the present embodiment, it is assumed that variable valve timing mechanism 113 is set to the most retard angle position in a state that engine 101 stops as well as the target value of when engine 101 starts is set to a value on an advance angle side of the most retard angle position.

At step S2, a maximum varied speed of the valve timing is calculated.

When the electromagnetic brake type mechanism shown in FIGS. 2 to 8 is used as variable valve timing mechanism 113, the valve timing of intake valve 105 is kept in the most retard angle state in an OFF state, namely, in a state where engine 101 stops. Accordingly, if the target of the valve timing at the time engine 101 starts is set to a value advanced from the most retard angle position, the valve timing is advanced from the most retard angle state and to the target at the engine start.

Further, in the electromagnetic brake type variable valve timing mechanism shown in FIGS. 2 to 8, the valve timing is advanced at a maximum speed by stopping the rotation of intake camshaft 134 to crank shaft 120. The maximum speed differs depending on the rotation speed of crank shaft 120, that is, the rotation speed NE of engine 101, at that time.

Thus, in an engine using the electromagnetic brake type variable valve timing mechanism shown in FIGS. 2 to 8, the correlation between the engine rotation speed NE and a maximum speed of an advance angle variation is previously stored as a conversion table or a function, and a maximum variation speed corresponding to the engine rotation speed NE at the time is determined based on the conversion table or the function.

Further, when the hydraulic type mechanism as shown in FIG. 15 is used as variable valve timing mechanism 113, since the variation speed of valve timing is determined by the hydraulic pressure, a maximum variation speed is determined from a maximum amount of hydraulic pressure that can be supplied at the time.

The maximum hydraulic pressure that can be supplied changes depending on the injection amount of an oil pump and the injection amount of the oil pump is proportional to the rotation speed of the oil pump. Thus, when an engine-driven oil pump is used, the maximum amount of the hydraulic pressure that can be supplied can be estimated based on the engine rotation speed NE.

Accordingly, also in variable valve timing mechanism 113 using the engine-driven oil pump, the maximum variation speed of the valve timing can be obtained from the engine rotation speed NE.

Further, when the electrically driven motor type mechanism shown in FIG. 9 is used as variable valve timing mechanism 113, since the rotation speed of the motor limits the variation speed of the valve timing, the maximum variation speed can be obtained from the maximum rotation speed of the motor.

Since the motor rotation speed in a maximum voltage that can be applied at the time is the maximum rotation speed, the maximum variation speed depending on a power supply voltage at the time can be obtained.

At next step S3, the valve timing at the time is estimated assuming that the valve timing is varied at the maximum variation speed obtained at step S2.

Since the valve timing at the time engine 101 stops is known, the amount of variation of the valve timing after variable valve timing mechanism 113 starts to be driven is obtained based on the period of time passed after it started to be driven and the maximum variation speed. As a result, the position, which is varied from the valve timing in the above stop state by the amount of variation, can be estimated as the valve timing at the time.

In the case where, for example, the valve timing in the state that engine 101 stops is located at the most retard angle position and a target at the start of engine 101 is located on a side where the angle thereof is advanced from the most retard angle position, and thus the angle of the valve timing is advanced from the time when variable valve timing mechanism 113 starts to be driven, the advance change amount, which is determined from the time passed after it started to be driven and the maximum variation speed is made to the amount of advance change amount from the most retard angle position up to the present time.

At step S4, whether or not the valve timing estimated at step S3 reaches the target value at the time is discriminated by comparing the valve timing estimated at step S3 with the target value at the time.

In other words, whether or not the estimated advance angle amount is equal or larger than a target advance angle amount is discriminated at step S4.

When the valve timing estimated at step S3 does not reach the target value at the time, that is, when the estimated advance angle amount is smaller than the target advance angle amount, the process goes to step S6.

At step S6, a second manipulated variable is calculated to realize the maximum variation speed of the valve timing.

In the electromagnetic brake type variable valve timing mechanism shown in FIGS. 2 to 8, since the maximum variation speed can be achieved by stopping the rotation of intake camshaft 134 as described above, the maximum variation speed can be achieve by generating brake torque which can stop the rotation of intake camshaft 134.

Thus, a manipulated variable for generating the brake torque which can stop the rotation of intake camshaft 134 is calculated as the second manipulated variable.

Since the torque required to stop the rotation of intake camshaft 134 differs depending on the engine rotation speed NE, an oil temperature (engine temperature), and the like, and further the manipulated variable, which is required to generate the same brake torque also differs depending on a power supply voltage at the time, the second manipulated variable is calculated based on the engine rotation speed NE, the oil temperature, a battery voltage, and the like.

When, for example, brake torque is controlled by controlling the duty ratio in a switching control of energization of electromagnetic coil 324, since an average apply voltage is lowered even in the same duty ratio when a battery has a low voltage and thus generated brake torque is made low, the duty ratio is more increased when the battery has a lower voltage. Further, since a larger amount of brake torque is required to a higher engine rotation speed NE, the duty ratio is increased. Still further when intake camshaft 134 has a smaller amount of friction because an oil temperature is high, since a larger amount of brake torque is required, the duty ratio is more increased.

The second manipulated variable can be calculated based on at least one of the battery voltage (power supply voltage), the engine rotation speed NE, and the oil temperature.

Since the oil temperature is a parameter representative of the temperature of engine 101, the second manipulated variable can be calculated by using a cooling water temperature, a cylinder block temperature, and the like in place of the oil temperature.

Further, a hydraulic pressure type mechanism as shown in FIG. 15 is used as variable valve timing mechanism 113, hydraulic pressure is supplied and discharged in a maximum amount by keeping a maximum opening area to hydraulic pressure paths through which the hydraulic pressure is supplied and discharged, so that the valve timing is varied at a maximum speed.

Thus, a manipulated variable, which can keep the hydraulic pressure paths which advances the valve timing by being opened to the maximum opening area, is calculated as the second manipulated variable.

When, for example, a hydraulic control valve for opening and closing a hydraulic pressure path, controls hydraulic pressure in response to a duty ratio in the switching control of energization and the hydraulic pressure is controlled in a direction in which the valve timing is changed to be advanced by increasing the duty ratio, a maximum duty ratio is set to the second manipulated variable.

Further, when the electrically driven motor type mechanism shown in FIG. 9 is used as variable valve timing mechanism 113, a manipulated variable by which the rotation speed of electrically driven motor 2060 is maximized is set as the second manipulated variable for achieving the maximum variation speed.

When, for example, the duty ratio in the switching control of energization of the motor is controlled, the maximum duty ratio by which an average application voltage is maximized is used as the second manipulated variable.

At step S7, the second manipulated variable obtained at step S6 is output to the actuator of variable valve timing mechanism 113 so that the valve timing of intake valve 105 is varied at a maximum speed to the target at the time of start by operating variable valve timing mechanism 113 at a maximum speed.

While it is determined at step S4 that the valve timing estimated at step S3 does not reach the target value at the time, the second manipulated variable by which the maximum variation speed is achieved is continuously output.

Note that since the valve timing is estimated at step S3 assuming that variable valve timing mechanism 113 is operated at an estimated maximum variation speed, the angle of actual valve timing is not more advanced than a result of the above estimation.

Accordingly, while it is judged at step S4 that the valve timing estimated at step S3 does not reach the target value at the time, even if the second manipulated variable by which the valve timing is varied at the maximum speed is continuously output, the angle of the actual valve timing is not advanced exceeding the target value.

In contrast, the valve timing can be advanced at a fastest speed from the most retard angle position of when engine 101 stops to the target value of when engine 101 starts. As a result, a period of time required to start engine can be reduced by promptly changing the valve timing to the valve timing which is required in the start state.

When it is judged at step S4 that the valve timing estimated at step S3 reaches the target value at the time while the second manipulated variable by which the valve timing is varied at the maximum speed is output, the process goes from step S4 to step S5 judging that the second manipulated variable is not required to be output thereafter That is, the valve timing is promptly varied to the vicinity of the target by outputting the second manipulated variable until it approach the target value at the time of start, and thereafter the second manipulated variable is switched to the first manipulated variable which is set based on the target value so that the valve timing is converged to the vicinity of the target.

At step S5, it is determined whether or not the actual valve timing (advance angle amount) is detected based on the phase difference between the reference crank angle signal REF and the cam signal CAM.

Although it is estimated that the actual valve timing is located in the vicinity of the target value by the output of the second manipulated variable before the actual valve timing (advance angle amount) is detected for the first time, a feedback control can not be executed because the actual valve timing is not detected.

Thus, when it is determined that the actual valve timing is not detected at step S5, the process goes to step S8. At step 8, the feedback manipulated variable FB is not output as the manipulated variable, and the feedforward manipulated variable FF, which is calculated by the arrangement shown in a block diagram of FIG. 17 is output as the first manipulated variable of variable valve timing mechanism 113.

In other words, an open control state, in which the feedback control is stopped, is used by clamping the output of feedback manipulated variable calculation unit 503.

When the feedforward control is executed without executing the feedback control as described above, it can be suppressed that an excessive manipulated variable is applied in a state that the actual valve timing is not detected and the actual valve timing is overshot beyond a target.

In contrast, when it is judged that the actual valve timing is detected at step S5, the process goes to step S9 at which the first manipulated variable, which is obtained by adding the feedback manipulated variable FB and the feedforward manipulated variable FF that are calculated based on a result of detection, is output to variable valve timing mechanism 113.

Accordingly, when the actual valve timing is detected before it is judged that the valve timing estimated based on the maximum variation speed reaches the target value at the time, the second manipulated variable, which achieves the maximum variation speed, is switched to the first manipulated variable obtained by adding the feedback manipulated variable FB and the feedforward manipulated variable FF.

Further, when the actual valve timing is detected after it is judged that the valve timing estimated based on the maximum variation speed reaches the target value at the time, the second manipulated variable for achieving the maximum variation speed is switched to the first manipulated variable composed of the feedforward manipulated variable FF, and further when the actual valve timing is detected thereafter, the above first manipulated variable is switched to the first manipulated variable obtained by adding the feedback manipulated variable FB and the feedforward manipulated variable FF (refer to FIG. 20).

Accordingly, when the actual valve timing is detected, the actual valve timing can be converged to the target with high accuracy by the feedback control.

Figure 21:
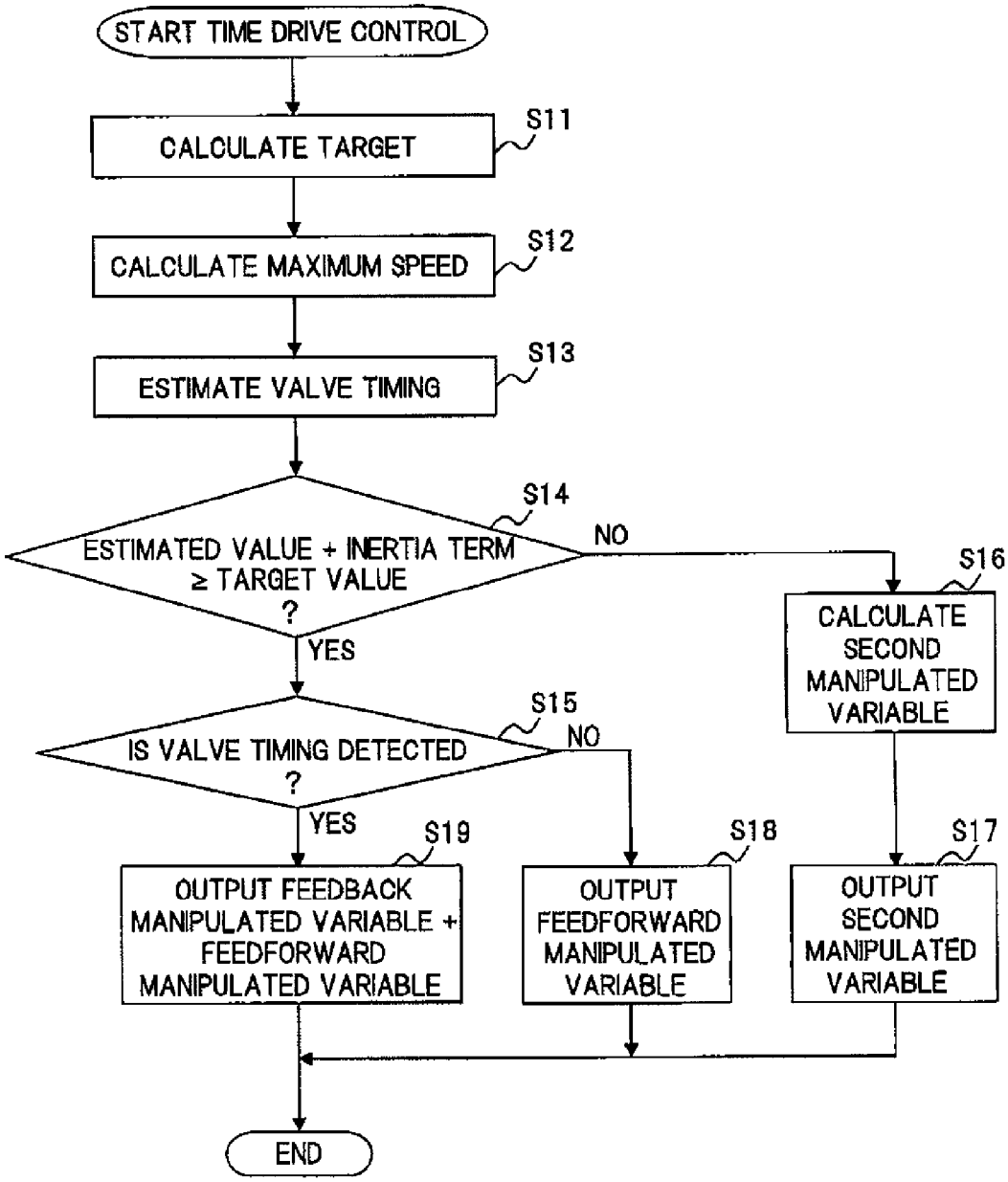
FIG. 21 is a flowchart illustrating a second embodiment of the control of the variable valve timing mechanism according to the present invention.
Figure 22:
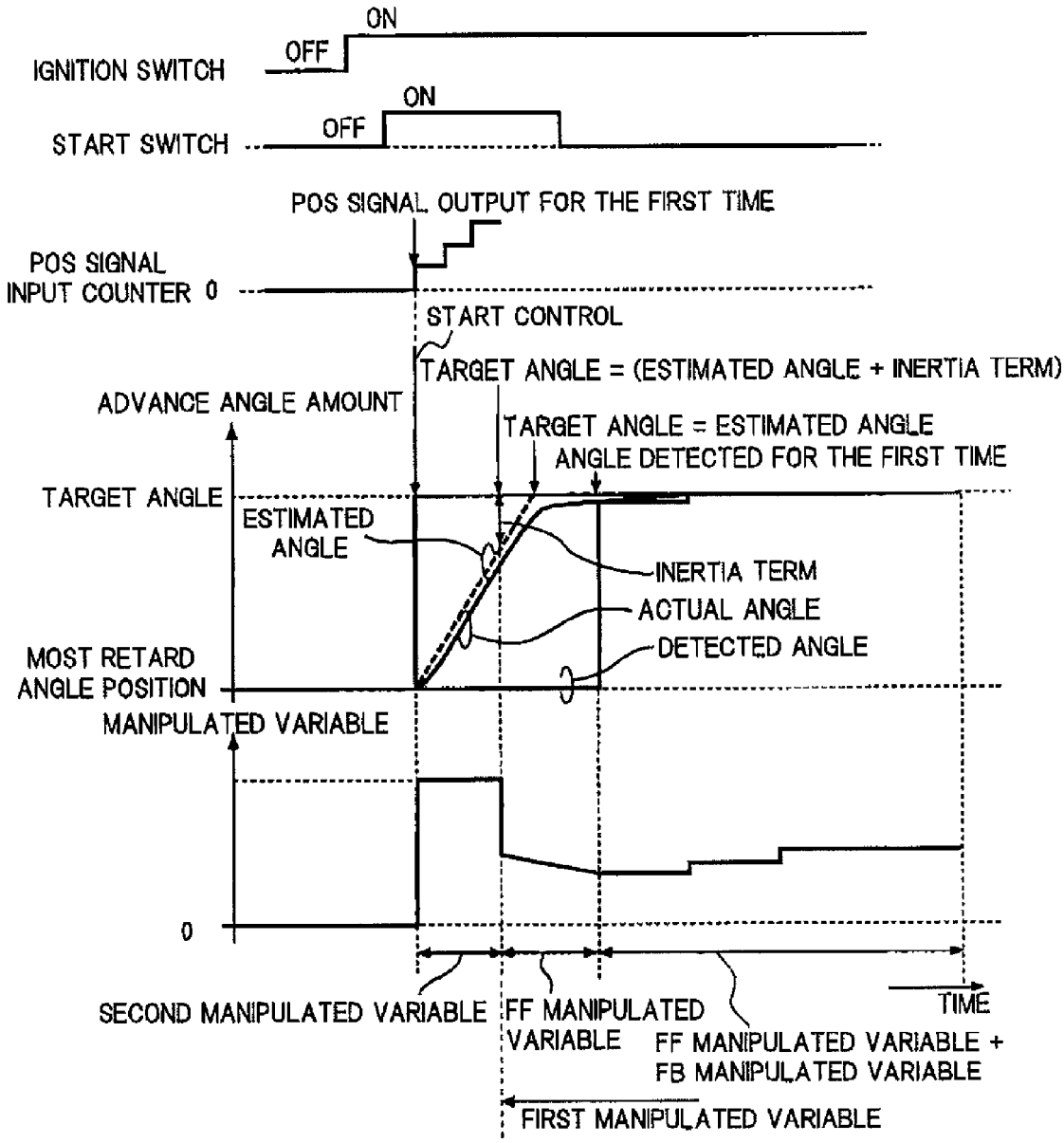
FIG. 22 is a time chart illustrating a change of valve timing and the manipulated variable of the second embodiment.

A routine shown in a flowchart of FIG. 21 shows a second embodiment of the control of variable valve timing mechanism 113, and a time chart of FIG. 22 shows changes of valve timing and a manipulated variable in the second embodiment.

In the flowchart of FIG. 21, the steps executed at respective steps S11 to S13 and S15 to S19 (i.e., except step S14) are the same as those executed at respective steps S1 to S3 and S5 to S9 of the flowchart of FIG. 19. Accordingly, as for the second embodiment shown in the flowchart of FIG. 21, the portion at step S14 which is different from the first embodiment will be described.

At step S14, a target value is compared with a sum of an estimated value of valve timing and inertia term.

Even if the second manipulated variable, which varies the valve timing at the maximum speed, is changed to the first manipulated variable, which is composed of the feedforward manipulated variable FF or composed of the feedforward manipulated variable FF and the feedback manipulated variable FB, the valve timing is continuously varied to be advanced by inertia when a response of variable valve timing mechanism 113 is fast, and thus there is a possibility that the valve timing exceeds the target value.

Thus, by comparing a result of addition of the inertia term to the estimated value of the valve timing with the target value, even if an valve timing is advanced by the inertia, the second manipulated variable, which varies the valve timing at the maximum speed, is switched to the first manipulated variable which is composed of the feedforward manipulated variable FF or the sum of the feedforward manipulated variable FF and the feedback manipulated variable FB in a state where the angle of the actual valve timing is not more advanced than the target value.

In other words, the second manipulated variable, which varies the valve timing at the maximum speed, is switched to the first manipulated variable, which is the feedforward manipulated variable FF or the sum of the feedforward manipulated variable FF and the feedback manipulated variable FB at the time when an estimated result of the valve timing reaches the valve timing on a retard angle side where it is retarded by the inertia term from the target value.

The inertia term may be a fixed value and can be calculated based on the acceleration of the estimated value of the valve timing.

While the target value is greater than the sum of the estimated value of valve timing and the inertia term, namely, the sum of the estimated value of the valve timing and the inertia term is located on the retard angle side the target value, the process goes to steps S16, S17 at which the second manipulated variable, which varies the valve timing at the maximum speed, is output to variable valve timing mechanism 113.

In contrast, when the target value is equal to or less than the sum of the estimated value of the valve timing and the inertia term, namely, the sum of the estimated value of the valve timing and the inertia term is the same as the target value or on a more advanced side, the process goes to step S18 or step S19 via step S15 At step S18 or S19, the second manipulated variable is switched to the sum of the feedforward manipulated variable FF and feedback manipulated variable FB after a period in which the feedforward manipulated variable FF is output, or the second manipulated variable is directly switched to the sum of the feedforward manipulated variable FF and the feedback manipulated variable FB.

According to the second embodiment, when the second manipulated variable, which varies the valve timing at the maximum speed, is output, the timing at which the second manipulated variable is switched to the feedforward manipulated variable FE or to the sum of the feedforward manipulated variable FF and the feedback manipulated variable FB is judged in consideration of the variation of the valve timing to be advanced by the inertia. As a result, it is able to avoid the valve timing from exceeding the target while varying it to the vicinity of the target at the maximum speed.

Figure 23:
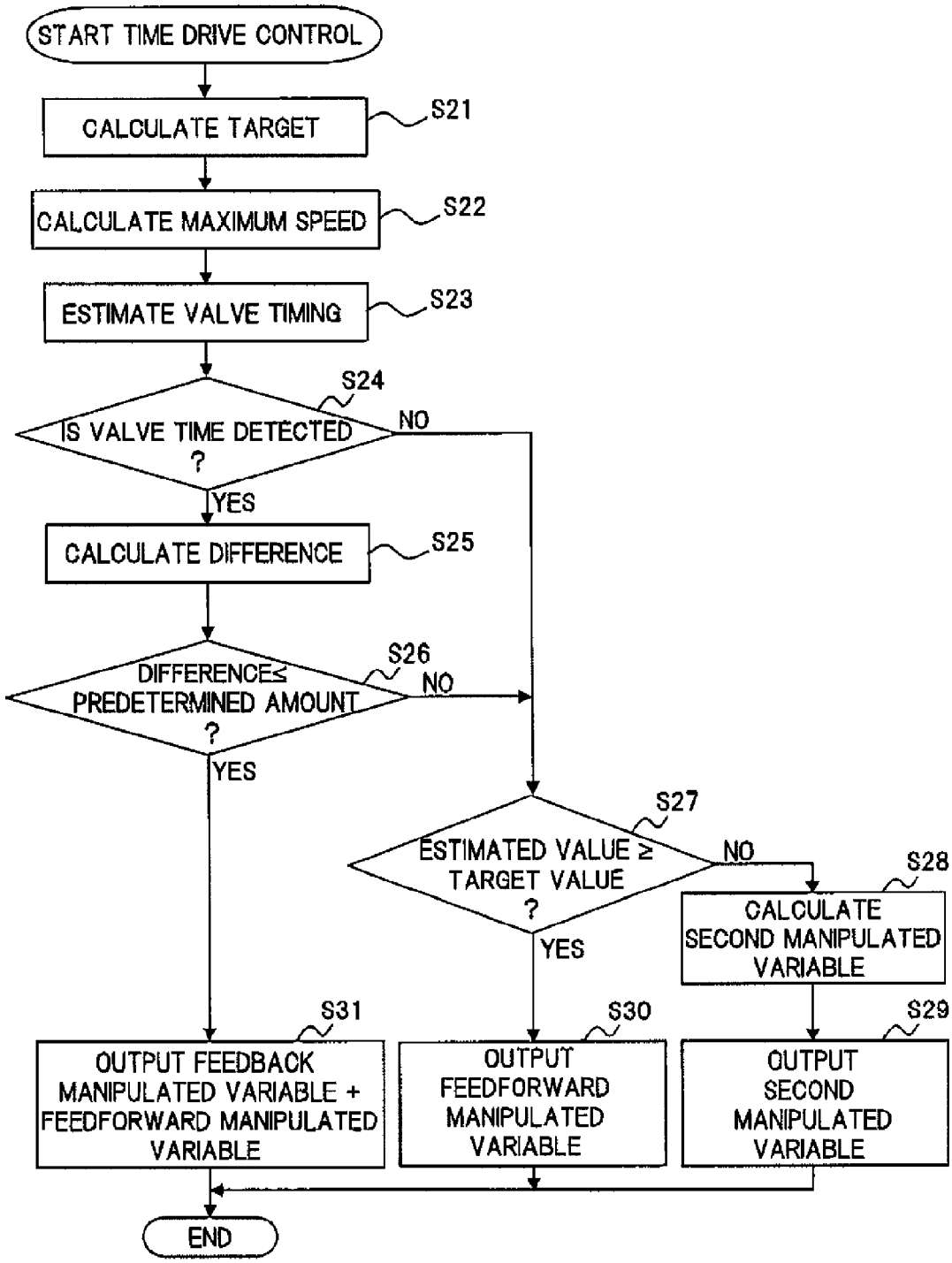
FIG. 23 is a flowchart illustrating a third embodiment of the control of the variable valve timing mechanism according to the present invention.
Figure 24:
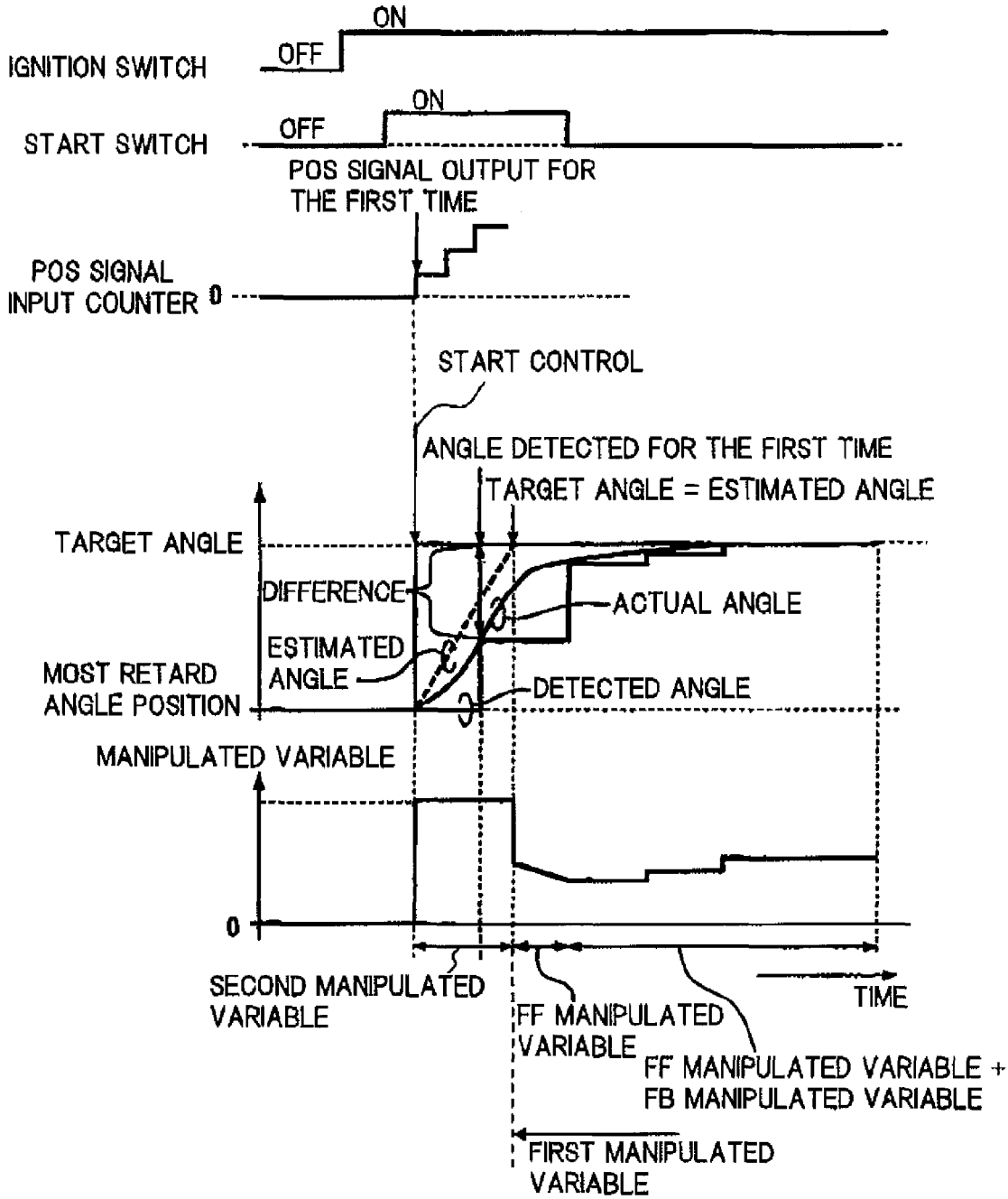
FIG. 24 is a time chart illustrating the change of valve timing and the manipulated variable of the third embodiment.

A routine shown in a flowchart of FIG. 23 shows a third embodiment of a control of a variable valve timing mechanism 113 at an engine start, and a time chart of FIG. 24 shows the change of an valve timing and a manipulated variable in the third embodiment.

In the flowchart of FIG. 23, steps S21 to S23 execute the same process as that of steps S1 to S3 of the flowchart of FIG. 19 At step S24, it is determined whether or not an actual valve timing (advance angle amount) is detected based on the phase difference between a reference crank angle signal REF and a cam signal CAM likewise step S5.

In a state where the valve timing of an intake valve 105, in other words, the rotating phase of an intake camshaft 134 is not detected while an engine 101 starts to rotate, the process goes to step S27.

At step S27, it is determined whether or not the estimated valve timing is advanced to the vicinity of a target value by comparing the target value with the valve timing estimated based on a maximum variation speed.

When the estimated valve timing does not advance to the vicinity of the target value, the process goes to steps S28 and S29 at which a second manipulated variable, which varies the valve timing at a maximum speed, is output to variable valve timing mechanism 113 likewise steps S6, S7.

In contrast, when the estimated value of the valve timing reaches the target value, the process goes to step S30 at which only a feedforward manipulated variable FF is output likewise step S8.

In contrast, when it is judged that the actual valve timing is detected based on an output from a sensor at step S24, the process goes to step S25 at which the difference between the actual valve timing, which is detected based on the phase difference between the reference crank angle signal REF and the cam signal CAM, and the target value is calculated.

At next step S26, it is determined whether or not the absolute value of the difference is equal to or less than a threshold value.

When the absolute value of the difference exceeds the threshold value, it is difficult to advance the angle of the valve timing to the target value by a feedback control with good responsiveness. Thus, the process goes to step S27, and then when the estimated value of the angle of the valve timing does not advance to the vicinity of the target value at step 27, the process goes to steps S28 and S29, at which the second manipulated variable, which varies the valve timing at the maximum speed, is output to variable valve timing mechanism 113 likewise steps S6, S7.

In contrast, when the absolute value of the difference is equal to or less than the threshold value, it is judged that the angle of the valve timing is actually advanced to the vicinity of the target value by the second manipulated variable, which varies the valve timing at the maximum speed, or by the feedforward manipulated variable FF. Thus, the process goes to step S31 at which a first manipulated variable of the sum of the feedforward manipulated variable FF and the feedback manipulated variable FB is output.

That is, in the third embodiment, when the actual valve timing is detected based on the phase difference between the reference crank angle signal REF and the cam signal CAM before the valve timing estimated based on the maximum variation speed reaches the target value, and moreover when the actual valve timing sufficiently approaches the target value, the feedback control is started.

In contrast, in the first and second embodiments, the feedback control is not started until the valve timing estimated based on the maximum variation speed reaches the target value.

Accordingly, in the third embodiment, when the actual valve timing is detected at relatively early timing based on the phase difference between the reference crank angle signal REF and the cam signal CAM, the converging property of the actual valve timing to the target value can be improved.

At step S27, "the estimated value of the valve timing+the inertia term" can be compared with "the target value".

Further, although variable valve timing mechanism 113 that varies the valve timing of intake valve 105 is employed in the above-mentioned embodiments, a variable valve timing mechanism that varies the valve timing of exhaust valve 107 may be employed.

Further, the control of the valve timing at the engine start may be a retard angle control from a maximum advance angle position in a state that the engine stops.

Further, when the valve timing set in the state that the engine stops differs from a target valve timing at the engine start, the valve timing when the engine stops may be located at an intermediate position different from the most advance angle position or the most retard angle position.

The entire contents of Japanese Patent Application No. 2008-136849, filed May 26, 2008 are incorporated herein by reference.

While only selected embodiments have been chosen to illustrate the present invention, it will be apparent to those skilled in the art from this disclosure that various change and modification can be made herein without departing from the scope of the invention as defined in the appended claims.

Furthermore, the foregoing description of the embodiments according to the present invention are provided for illustration only, and not for the purpose of limiting the invention as defined by the appended claims and their equivalents.

We claim:

1. An apparatus of controlling a variable valve timing mechanism that varies valve timing of an engine valve, comprising:

a target calculation unit that calculates target valve timing;

a first calculation unit that calculates a first manipulated variable based on the target valve timing;

a second calculation unit that calculates a second manipulated variable by which a variation speed of valve timing is maximized;

an estimation unit that estimates valve timing of when the second manipulated variable is output to the variable valve timing mechanism;

a determination unit that determines timing at which the second manipulated variable is switched to the first manipulated variable based on a comparison of an estimated valve timing with the target valve timing; and an operation unit that outputs the second manipulated variable to the variable valve timing mechanism in a period after a start of an engine and before it is determined to be the switching timing, and outputs the first manipulated variable to the variable valve timing mechanism in a period after it is determined to be the switching timing.

2. The apparatus according to claim 1, wherein the determination unit determines the timing at which the estimated valve timing reaches the target valve timing, as timing at which the second manipulated variable is switched to the first manipulated variable.

3. The apparatus according to claim 1, wherein:

the variable valve timing mechanism is a mechanism that varies valve timing of an intake valve, which is controlled to a most retard angle position in a state where the engine stops; and a target valve timing at the start of the engine, which is calculated by the target calculation unit, is an angle position which is advanced from the most retard angle position.

4. The apparatus according to claim 1, wherein;

the first calculation unit has a second target calculation unit that calculates second target valve timing which follows a variation of the target valve timing with a predetermined response; and the first calculation unit calculates the first manipulated variable based on the second target valve timing.

5. The apparatus according to claim 1 further comprising a detection unit that detects the valve timing, wherein the first calculation unit comprises a feedforward calculation unit that calculates a feedforward manipulated variable based on the target valve timing, and a feedback calculation unit that calculates a feedback manipulated variable based on the target valve timing and the detected valve timing, and wherein the operation unit outputs the feedforward manipulated variable as the first manipulated variable until a first detection is executed by the detection unit, and outputs a value obtained by adding the feedforward manipulated variable and the feedback manipulated variable as the first manipulated variable after the first detection is executed by the detection unit.

6. The apparatus according to claim 1, wherein:

the estimation unit comprises an inertia calculation unit that calculates the amount of variation of valve timing caused by inertia when the second manipulated variable is output to the valve timing mechanism, wherein, the estimated valve timing is corrected by the amount of variation.

7. The apparatus according to claim 6, wherein the inertia calculation unit calculates the amount of variation of valve timing caused by the inertia based on an acceleration of the estimated valve timing.

8. The apparatus according to claim 1, further comprising a maximum speed calculation unit that calculates a maximum variation speed of the valve timing, wherein the estimation unit estimates valve timing assuming that valve timing varies at the maximum variation speed.

9. The apparatus according to claim 8, wherein the variable valve timing mechanism is a mechanism that varies a rotating phase of a camshaft relative to a crank shaft by adding brake torque to the camshaft; and the maximum speed calculation unit calculates the maximum variation speed of the valve timing based on an engine rotation speed.

10. The apparatus according to claim 8, wherein;

the variable valve timing mechanism is a mechanism using an electrically driven motor as an actuator; and the maximum speed calculation unit calculates the maximum variation speed based on a maximum rotation speed of the electrically driven motor.

11. The apparatus according to claim 8, wherein:

the variable valve timing mechanism is a mechanism using a hydraulic actuator as an actuator, and the maximum speed calculation unit calculates the maximum variation speed based on hydraulic pressure.

12. The apparatus according to claim 1, wherein the variable valve timing mechanism is a mechanism that varies a rotating phase of the camshaft relative to the crank shaft by adding the brake torque to the camshaft, and the second calculation unit calculates the second manipulated variable based on at least one of a power supply voltage of the variable valve timing mechanism, the engine rotation speed, and a temperature of engine.

13. The apparatus according to claim 1, wherein:

the variable valve timing mechanism is a mechanism using an electrically driven motor as an actuator; and the second calculation unit calculates the second manipulated variable based on a maximum rotation speed of the electrically driven motor.

14. The apparatus according to claim 1, wherein:

the variable valve timing mechanism is a mechanism that varies valve timing by a hydraulic pressure control executed by a hydraulic pressure control valve; and the second calculation unit calculates a manipulated variable by which the opening area of the hydraulic pressure control valve is maximized, as the second manipulated variable.

15. A method of controlling a variable valve timing mechanism that varies valve timing of an engine valve, comprising the steps of:

calculating target valve timing;

calculating a first manipulated variable based on the target valve timing, calculating a second manipulated variable by which a variation speed of valve timing is maximized;

estimating valve timing of when the second manipulated variable is output to the variable valve timing mechanism;

comparing an estimated valve timing with the target valve timing;

determining timing at which the second manipulated variable is switched to the first manipulated variable based on a result of the comparison;

outputting the second manipulated variable to the variable valve timing mechanism in a period after a start of an engine and before it is determined to be the switching timing; and outputting the first manipulated variable to the variable valve timing mechanism in a period after it is determined to be the switching timing.

16. The method according to claim 15, wherein:

the comparison step determines whether or not the estimated valve timing reaches the target valve timing; and the switching timing determination step determines the timing at which the estimated valve timing reaches the target valve timing, as timing at which the second manipulated variable is switched to the first manipulated variable.

17. The method according to claim 15, wherein the valve timing estimation step estimates valve timing assuming that the valve timing varies at a maximum variation speed.

18. The method according to claim 15, wherein the valve timing estimation step comprises the steps of:

calculating an amount of variation of valve timing caused by inertia when the second manipulated variable is output to the variable valve timing mechanism; and correcting the estimated valve timing by the amount of variation.

19. The method according to claim 15, wherein the step of calculating the first manipulated variable comprises:

calculating a feedforward manipulated variable based on the target valve timing;

detecting the valve timing; and calculating a feedback manipulated variable based on the detected valve timing and the target valve timing, wherein the step of outputting the first manipulated variable to the variable valve timing mechanism comprises the steps of:

outputting the feedforward manipulated variable as the first manipulated variable until the valve timing is detected for a first time; and outputting a value obtained by adding the feedforward manipulated variable and the feedback manipulated variable as the first manipulated variable after the valve timing is detected for a first time.

20. An apparatus of controlling of a variable valve timing mechanism that varies valve timing of an engine valve, comprising:

target calculation means for calculating target valve timing;

first calculation means for calculating a first manipulated variable based on the target valve timing;

second calculation means for calculating a second manipulated variable by which a variation speed of valve timing is maximized;

estimation means for estimating valve timing of when the second manipulated variable is output to the variable valve timing mechanism;

determination means for determining timing at which the second manipulated variable is switched to the first manipulated variable based on a comparison of the estimated valve timing with the target valve timing; and operation means for outputting the second manipulated variable to the variable valve timing mechanism in a period after a start of an engine and before it is determined to be the switching timing, and outputting the first manipulated variable to the variable valve timing mechanism in a period after it is determined to be the switching timing.

* * * * *